US008592313B2

(12) United States Patent
Yamaguchi et al.

(10) Patent No.: US 8,592,313 B2
(45) **Date of Patent: *Nov. 26, 2013**

(54) POLISHING METHOD AND POLISHING APPARATUS

(75) Inventors: Kuniaki Yamaguchi, Tokyo (JP); Tsuneo Torikoshi, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/167,952

(22) Filed: Jun. 24, 2011

(65) Prior Publication Data

US 2011/0250824 A1 Oct. 13, 2011

Related U.S. Application Data

(62) Division of application No. 11/508,140, filed on Aug. 23, 2006, now Pat. No. 7,989,348.

(30) Foreign Application Priority Data

Aug. 26, 2005 (JP) ..... 2005-246509

(51) Int. Cl.
*H01L 21/302* (2006.01)
*H01L 21/461* (2006.01)

(52) U.S. Cl.
USPC ..... 438/691; 438/692; 438/694; 216/84; 216/89

(58) Field of Classification Search
USPC ..... 438/691, 692, 694; 216/84, 89
See application file for complete search history.

(56) References Cited

U.S. PATENT DOCUMENTS 6,045,716 A 4/2000 Walsh et al.
6,776,692 B1 8/2004 Zuniga et al.
6,914,000 B2 7/2005 Kamada
6,929,531 B2 * 8/2005 Gotkis et al. ..... 451/8
7,008,296 B2 3/2006 Swedek et al.
7,018,271 B2 3/2006 Wiswesser et al.
7,989,348 B2 * 8/2011 Yamaguchi et al. ..... 438/691
2002/0058460 A1 5/2002 Lee et al.
2003/0119322 A1 * 6/2003 Hirai et al. ..... 438/692
2004/0023490 A1 2/2004 Wollstein et al.

(Continued)

FOREIGN PATENT DOCUMENTS

JP 10-106984 4/1998
JP 2002-219645 8/2002

(Continued)

*Primary Examiner* — Binh X Tran
(74) *Attorney, Agent, or Firm* — Wenderoth, Lind & Ponack, L.L.P.

(57) ABSTRACT

A polishing method that carries out a multi-step polishing process with improved polishing conditions (polishing recipe) while omitting measurement of the surface conditions of a substrate, as carried out between polishing steps thereby increasing the throughput. The polishing method for polishing workpieces by repeating the sequential operations of taking a workpiece out of a cassette in which a plurality of workpieces are stored, carrying out multi-step polishing of a surface of the workpiece and returning the workpiece to the cassette, includes carrying out one of the following two polishing processes for the workpiece taken out of the cassette: a first polishing process comprising carrying out the multi-step polishing under preset conditions and measurement of the surface of the workpiece before and after each polishing step; and a second polishing process comprising carrying out a predetermined step of the multi-step polishing under polishing conditions which have been modified based on the results of the measurement.

5 Claims, 18 Drawing Sheets

(56) References Cited

U.S. PATENT DOCUMENTS

| | | | | |
|---|---|---|---|---|
| 2004/0029333 | A1 | 2/2004 | Matsukawa | |
| 2005/0142991 | A1 | 6/2005 | Nakao et al. | |
| 2005/0143852 | A1* | 6/2005 | Roover et al. | 700/121 |
| 2005/0202756 | A1* | 9/2005 | Moore et al. | 451/5 |
| 2006/0166503 | A1 | 7/2006 | Sasaki et al. | |
| 2007/0235133 | A1* | 10/2007 | Benassi | 156/345.12 |

FOREIGN PATENT DOCUMENTS

| | | |
|---|---|---|
| KR | 2002-0022424 | 3/2002 |
| WO | 2004/065664 | 8/2004 |
| WO | 2004/113020 | 12/2004 |

* cited by examiner

FIG. 15A

| decrease in film thickness (nm) | time (sec) |
|---|---|
| ~600 | 65 |
| ~500 | 49 |
| ~400 | 30 |
| ~300 | 23 |
| ~200 | 18 |
| ~100 | 11 |

FIG. 15B

| decrease in film thickness (nm) | time (sec) |
|---|---|
| 600 | 65 |
| 500 | 49 |
| 400 | 30 |
| 300 | 23 |
| 200 | 18 |
| 100 | 11 |

FIG. 21A actual film thickness value

| type of film | film thickness |
|---|---|
| oxide film | 600 |
| SiN | 100 |

| type of film | film thickness |
|---|---|
| oxide film | 600 |

inter-locking

| | type of film | film thickness |
|---|---|---|
| HH | oxide film | 100 |
| H | oxide film | 0 |
| L | SiN | 30 |
| LL | SiN | 20 |

target value

| type of film | film thickness |
|---|---|
| SiN | 50 |

selectivity oxide film:SiN=5:1

FIG. 21B synthetic film thickness value

| type of film | film thickness |
|---|---|
| oxide film | 600+100×5=1100 |

| type of film | film thickness |
|---|---|
| oxide film | 600 |

| | type of film | film thickness |
|---|---|---|
| HH | oxide film | 100+100×5=600 |
| H | oxide film | 0+100×5=500 |
| L | oxide film | 0+30×5=150 |
| LL | oxide film | 0+20×5=100 |

| type of film | film thickness |
|---|---|
| oxide film | 0+50×5=250 |

POLISHING METHOD AND POLISHING APPARATUS

CROSS-REFERENCE TO RELATED APPLICATION

This application is a divisional of U.S. application Ser. No. 11/508,140, filed Aug. 23, 2006, now U.S. Pat. No. 7,989, 348, the entirety of which is incorporated herein by reference.

BACKGROUND OF THE INVENTION

1. Field of the Invention

The present invention relates to a polishing method and a polishing apparatus for polishing and flattening a surface (surface to be polished) of a substrate, such as a semiconductor wafer.

2. Description of the Related Art

A multi-step chemical mechanical polishing (CMP) process is known in which a surface (surface to be polished) of a substrate, such as a semiconductor wafer, is polished in a plurality of polishing steps. For example, in the case of polishing a surface of a substrate by a two-step polishing process, the first-step polishing may be carried out by using a polishing liquid (slurry) having a high polishing rate, though having a low irregularities eliminating property, and carrying out the second-step polishing by using a polishing liquid having a low polishing rate, but having a high irregularities eliminating property. By earning a polishing amount by the first-step polishing, the total polishing time can be shortened.

In carrying out a multi-step polishing process for a plurality of substrates, such as semiconductor wafers, in a successive manner, it is a conventional practice to measure surface conditions, such as a thickness of a film, of each substrate before polishing, between polishing steps and after polishing, and feed back a measured value to optimally modify (renew) polishing conditions, i.e., polishing recipe (prescription of pressure distribution, polishing time, etc), for the next substrate or a later Nth substrate.

Measurement of the surface conditions of a substrate, such as a semiconductor wafer, is commonly carried out with a measurement section called ITM (in-line thickness monitor). An ITM is generally disposed outside a polishing section which carries out polishing; and in order to measure the surface conditions of a substrate with the ITM, it is necessary to take the substrate out of the polishing section, and clean and dry the substrate. Thus, in carrying out a multi-step polishing process successively for a plurality of substrates, it is common practice to take a substrate out of a polishing section between polishing steps or after polishing, and clean and dry the substrate to measure the surface conditions of the substrate with an ITM.

The operations of taking a substrate out of a polishing section, and cleaning and drying the substrate, if carried out for every measurement of the surface conditions of a substrate such as a semiconductor wafer, take a great deal of time. Especially in the case of carrying out a multi-step polishing process successively for a plurality of substrates, it is a conventional practice to measure the surface conditions of each substrate with an ITM even between the respective polishing steps and feed back the measurement results to optimally modify (renew) the polishing recipe. Thus, the time taken for measuring the surface conditions of a substrate increases the total polishing time, causing lowering of the throughput.

SUMMARY OF THE INVENTION

The present invention has been made in view of the above situation. It is therefore an object of the present invention to provide a polishing method and a polishing apparatus which make it possible to carry out a multi-step polishing process with improved polishing conditions (polishing recipe) while omitting measurement of the surface conditions of a substrate, as carried out between polishing steps, as much as possible, thereby increasing the throughput.

The present invention provides a polishing method for polishing workpieces by repeating the sequential operations of taking a workpiece out of a cassette in which a plurality of workpieces are stored, carrying out multi-step polishing of a surface of the workpiece and returning the workpiece to the cassette, comprising carrying out one of the following two polishing processes for the workpiece taken out of the cassette: a first polishing process comprising carrying out the multi-step polishing under preset conditions and measurement of the surface of the workpiece before and after each polishing step; and a second polishing process comprising carrying out a predetermined step of the multi-step polishing under polishing conditions which have been modified based on the results of the measurement.

By carrying out the first polishing process on a workpiece and measuring the surface of the workpiece before and after the second-step polishing, and carrying out the second-step polishing of the second polishing process on a later workpiece under polishing conditions (polishing recipe) which have been modified based on the results of the measurement, the second-step polishing of the second polishing process can be carried out under the optimum polishing conditions. Furthermore, the second-step polishing of the second polishing process can be carried out successively without measuring the surface of the workpiece, e.g., with an ITM after the first-step polishing. This can increase the throughput.

Preferably, the surface conditions of the workpiece before or after the second polishing process are determined to modify the polishing conditions for the predetermined step of the second polishing process.

This can optimize the polishing conditions for the second step of the second polishing process based on information on the latest processed substrate.

The present invention provides another polishing method for polishing workpieces by repeating the sequential operations of taking a workpiece out of a cassette in which a plurality of workpieces are stored, carrying out multi-step polishing of a surface of the workpiece and returning the workpiece to the cassette, comprising carrying out one of the following two polishing processes for the workpiece taken out of the cassette: a first polishing process comprising carrying out multi-step polishing under preset conditions and measurement of the surface of the workpiece before and after each polishing step; and a second polishing process comprising carrying out at least one step of the multi-steps under polishing conditions which have been modified based on the results of the measurement.

This polishing method makes it possible to carry out at least one of the first step and the second step of the second polishing process under the optimum polishing conditions. Furthermore, the first-step polishing and the second-step polishing in the second polishing process can be carried out successively without measuring a surface of a workpiece between the steps.

Preferably, the surface conditions of the workpiece before or after the second polishing process are determined to modify the polishing conditions for the at least one step of the multi-steps of the second polishing process.

This can optimize the polishing conditions for at least one of the first and second steps of the second polishing process based on information on the latest processed workpiece.

In a preferred aspect of the present invention, the first polishing process is carried out on the first workpiece first taken out of the cassette, and the second polishing process is carried out on the second or later workpiece later taken out of the cassette.

This makes it possible to polish a plurality of workpieces successively on a lot basis, with one lot being a group of workpieces stored in a cassette or a group of workpieces having the same type of film to be polished, while increasing the throughput.

In a preferred aspect of the present invention, determination as to which one of the first polishing process and the second polishing process is to be carried out on a workpiece is made based on information on additional polishing for the workpieces which have been polished by the second polishing process.

By determining, for example, the incidence rate of additional polishing (re-work), and carrying out the first polishing process and resetting the polishing conditions when the incidence rate of additional polishing is higher than a set value or when a polished workpiece has large surface irregularities, the incidence rate of additional polishing can be controlled within a predetermined range.

The information on additional polishing is, for example, at least one of the number of workpieces which have undergone additional polishing, the rate of additional polishing, the level difference between the highest portion and the lowest portion in irregularities on a polished surface, the average or deviation of the polishing amounts of polished workpieces, and the upper or lower limit of polishing amount.

Preferably, the multi-step polishing in the first polishing process and that in the second polishing process are carried out by pressing the surface of the workpiece against a polishing pad having a polishing surface while moving the workpiece and the polishing pad relative to each other.

In this case, the polishing conditions for the first polishing process and the second polishing process are preferably set based on the degree of wear of the polishing pad and/or the temperature of the polishing surface of the polishing pad.

The precision of polishing can be enhanced by controlling the polishing conditions also taking account of the degree of wear of the polishing pad and/or the temperature of the polishing surface of the polishing pad.

In a preferred aspect of the present invention, the polishing conditions for the first polishing process and the second polishing process are set based the degree of wear of a consumable member used in the multi-step polishing of the first polishing process and that of the second polishing process.

The present invention provides yet another polishing method for polishing a surface of a workpiece having a laminate of a plurality of various films, comprising: preparing a polishing liquid having a selectivity for the various films; calculating a synthetic film thickness value by multiplying a thickness of each film of the various films by a coefficient corresponding to the selectivity, and setting polishing conditions based on the synthetic film thickness value; and polishing the surface of the workpiece by pressing the surface against a polishing surface while supplying the polishing liquid to the polishing surface.

According to this polishing method, even when various films are laminated on a workpiece, the various films can be polished successively under the same conditions as when polishing a single type of film regardless of whether an underlying layer has become exposed or not, and the polishing can be terminated when the polishing amount has reached a predetermined amount.

In a preferred aspect of the present invention, the surface conditions of the workpiece after polishing are calculated in advance of the polishing, and polishing conditions are set based on the predicted post-polishing surface conditions determined by the calculation.

The present invention provides a polishing apparatus comprising: a polishing section for carrying out multi-step polishing of a surface of a workpiece; a measurement section for measuring the surface of the workpiece; and a control section for setting polishing conditions based on the results of measurement with the measurement section of the surface of the workpiece; wherein the control section modifies polishing conditions for a predetermined step of polishing of the surface of a Nth workpiece based on the results of measurement of the surface of a workpiece before and after the predetermined step of polishing carried out under preset conditions.

The present invention provides another polishing apparatus comprising: a polishing section for carrying out multi-step polishing of a surface of a workpiece; a measurement section for measuring the surface of the workpiece; and a control section for setting polishing conditions based on the results of measurement with the measurement section of the surface of the workpiece; wherein the control section modifies polishing conditions for at least one step of polishing of the surface of a Nth workpiece based on the results of measurement of a surface of a workpiece before and after each step of polishing carried out under preset conditions.

Preferably, the control section includes a recording section for storing the results of measurement with the measurement section of the surface of the workpiece.

In a preferred aspect of the present invention, the control section refers to a recording medium which is provided in a cassette with a plurality of workpieces stored therein and in which information of the workpieces is recorded, and checks whether the information on the surface of the workpiece is stored in the recording section.

This can individually manage and use data having the same type of film to be polished as the same data group even when cassettes are different.

The present invention provides yet another polishing apparatus comprising: a top ring for holding a workpiece, having in a surface a laminate of various types of films, and pressing the workpiece against a polishing surface; a rotational drive section for rotating the top ring and the workpiece relative to each other; a first measurement section for measuring a load of the rotational drive section; a second measurement section for optically measuring a surface of the workpiece after polishing; and a control section for setting polishing conditions for polishing of a surface of a Nth substrate based on the results of measurement with the first measurement section and the results of measurement with the second measurement section.

In a preferred aspect of the present invention, the second measurement section measures the entire surface of the workpiece; the top ring includes an adjustment means for dividing the workpiece surface, pressing on the polishing surface, into a plurality of areas, and adjusting a pressure of each area on the polishing surface; and the control section adjusts a pressure applied by the top ring on each of the areas of the workpiece surface based on the results of measurement with the second measurement section.

The control section may adjust the polishing conditions, in terms of the polishing rate, based on the results of measurement with the second measurement section carried out at a plurality of points on the surface of the workpiece.

Alternatively, the control section may adjust the pressure of the top ring on each of the areas of the workpiece surface based on the results of measurement with the second measurement section carried out at a plurality points, not overlapping with the points used for the adjustment of the polishing rate, on the surface of the workpiece.

This can prevent a particular point on a surface of a workpiece from being used both for adjustment of the polishing rate and for adjustment of a pressure applied by the top ring on each area of the workpiece (profile control). Since simultaneous modifications of the polishing rate and the pressure at the particular point can thus be prevented, the particular point can be prevented from being polished excessively or, adversely, polished insufficiently.

The present invention provides yet another polishing apparatus comprising: a polishing section for polishing a workpiece having in a surface a laminate of a plurality of various films; a polishing liquid supply nozzle for supplying a polishing liquid having a selectivity for the various films; and a control section for setting polishing conditions in the polishing section; wherein the control section calculates a synthetic film thickness value by multiplying a thickness of each film of the various films by a coefficient corresponding to the selectivity, and sets polishing conditions for polishing the surface of the workpiece based on the synthetic film thickness value.

The present invention provides a program for controlling a polishing apparatus, which polishes workpieces by repeating the sequential operations of taking a workpiece out of a cassette in which a plurality of workpieces are stored, carrying out multi-step polishing of a surface of the workpiece and returning the workpiece to the cassette, to perform an operation of: modifying polishing conditions for a predetermined step of polishing of a surface of a Nth workpiece based on the results of measurement of a surface of a workpiece taken out of the cassette, carried out before and after the predetermined step of polishing carried out under preset conditions.

The present invention provides another program for controlling a polishing apparatus, which polishes workpieces by repeating the sequential operations of taking a workpiece out of a cassette in which a plurality of workpieces are stored, carrying out multi-step polishing of a surface of the workpiece and returning the workpiece to the cassette, to perform an operation of: modifying polishing conditions for at least one step of polishing of a surface of a Nth workpiece based on the results of measurement of a surface of a workpiece taken out of the cassette, carried out before and after each step of polishing carried out under preset conditions.

The present invention provides yet another program for controlling a polishing apparatus, which polishes workpieces by repeating the sequential operations of taking a workpiece out of a cassette in which a plurality of workpieces are stored, carrying out multi-step polishing of a surface of the workpiece and returning the workpiece to the cassette, to perform operations of: performing a first polishing process comprising carrying out the multi-step polishing under preset conditions and measurement of the surface of the workpiece before and after each polishing step, and a second polishing process comprising carrying out the second or later step of the multi-step polishing under polishing conditions which have been modified based on the results of the measurement; and changing polishing conditions from those of the second polishing process to those of the first polishing process.

BRIEF DESCRIPTION OF THE DRAWINGS

FIG. 15A is a diagram showing a relationship between polishing time and polishing amount in a processing time mode, and FIG. 15B is a diagram showing a relationship between polishing time and polishing amount in an approximation mode;

FIGS. 21A and 21B are diagrams showing a relationship between actual film thickness value and synthetic film thickness value.

DETAILED DESCRIPTION OF THE INVENTION

Preferred embodiments of the present invention will now be described with reference to the drawings. The following description illustrates the case of polishing and flattening a surface (surface to be polished) of a substrate, such as a semiconductor wafer, as a workpiece.

Figure 1:
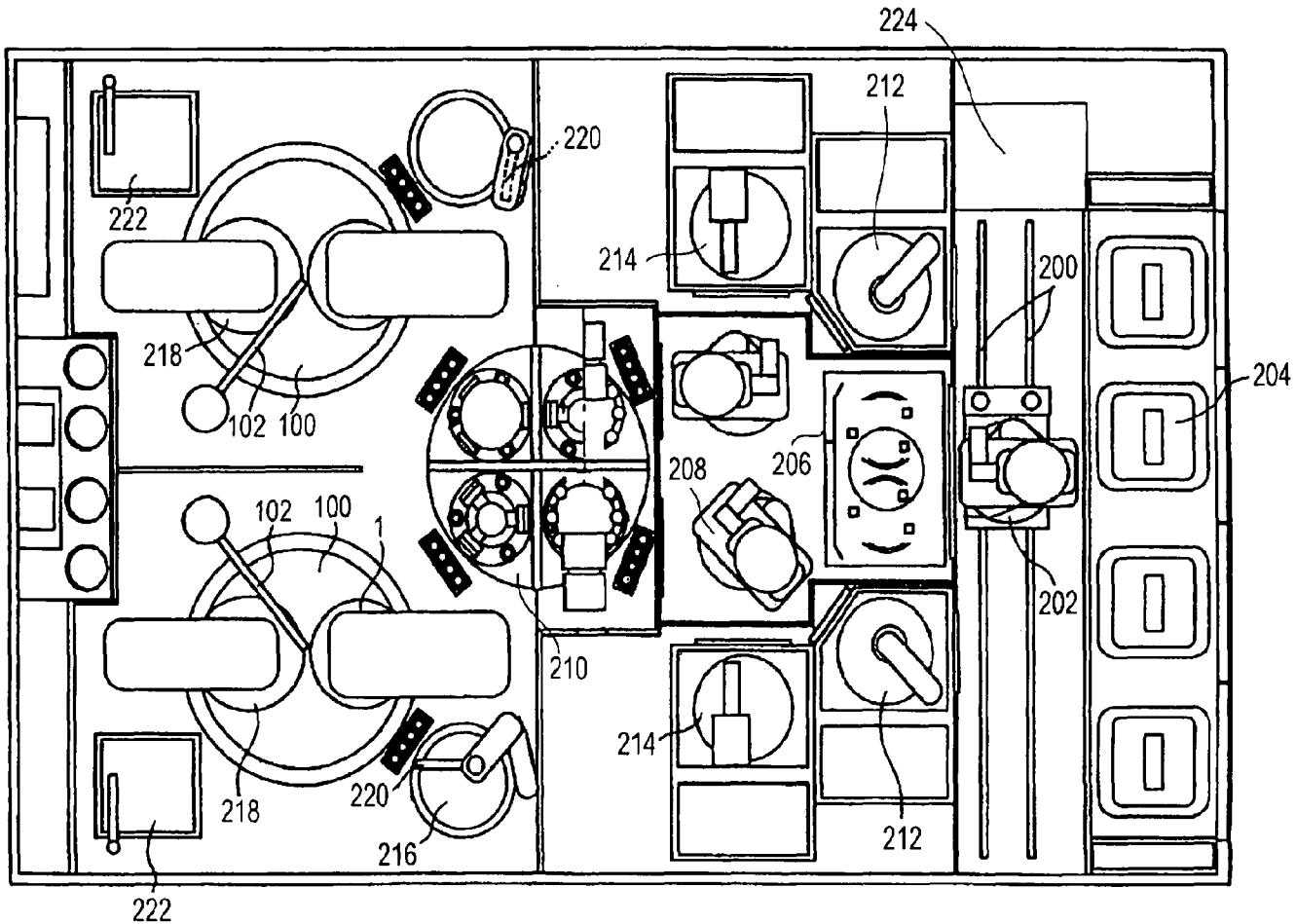
FIG. 1 is an overall plan view of a polishing apparatus according to an embodiment of the present invention.

FIG. 1 shows an overall layout plan view of a polishing apparatus according to an embodiment of the present invention. As shown in FIG. 1, in the polishing apparatus, unpolished substrates (workpieces), such as semiconductor wafers, stocked in a cassette 204 are taken one by one by a transport robot 202, which moves on traveling rails 200, out of the cassette 204, and placed on a substrate stage 206. The unpolished substrate on the substrate stage 206 is transferred by a transport robot 208 onto a rotary transporter 210, while a polished substrate is transferred by the transport robot 208 from the rotary transporter 210 onto the substrate stage 206. The polished substrate on the substrate stage 206 is returned by the transport robot 202 into the cassette 204. The unpolished substrate on the rotary transporter 210 is held by the below-described top ring 1 and moved to a position on a polishing table 100 to carry out polishing of the substrate. The polishing apparatus is thus systematized so that a plurality of substrates can be polished successively on a lot basis.

The polishing apparatus includes cleaning machines 212, 214 for cleaning and drying a substrate after polishing, a polishing table 216 for carrying out a second-step polishing of a substrate surface, dressers 218, 220 for carrying out dressing of the polishing tables 100, 216, and a water tub 222 for cleaning the dresser 218. The polishing apparatus is designed to be capable of carrying out two or more multi-step polishing with one polishing table 100 by switching a plurality of polishing liquids or a plurality of polishing conditions (polishing recipes).

The polishing apparatus may be provided with four polishing tables so that each set of two polishing tables can be operated to carry out two-step polishing or the four tables can be operated to carry out four-step polishing.

The polishing apparatus is provided with an ITM (in-line thickness monitor) 224 as a measurement section for measuring a surface state, such as a thickness of a surface film, of a substrate before polishing, between processes during a multi-step polishing process, or after post-polishing, cleaning and drying. In particular, the ITM (measurement section) 224 is disposed at a location lying on a line extending from the traveling rails 200, as shown in FIG. 1. The ITM 224 measures a thickness of an insulating film such as an oxide film, or the polishing state of a conductive film such as a copper film or a barrier layer, of a substrate, such as a semiconductor wafer, using an optical means which emits light toward the substrate surface and receives an optical signal of the reflected light, before the transport robot 202 places the substrate after polishing into the cassette 204 or after the transport robot 202 takes the substrate before polishing out of the cassette 204 (In-line).

The polishing apparatus is designed to detect removal of a surface conductive film of a substrate in other regions than necessary regions such as interconnect regions, or removal of an insulating film during and/or after polishing by monitoring sensor signals or measured values, and can determine the polishing conditions and the end point of polishing in each step of a multi-step polishing process and repeat an appropriate polishing process. The ITM 224 can measure the surface conditions of a substrate over an entire surface (surface to be polished). It is therefore possible to examine the results of polishing either at a particular portion of a substrate or over the entire substrate.

Figure 2:
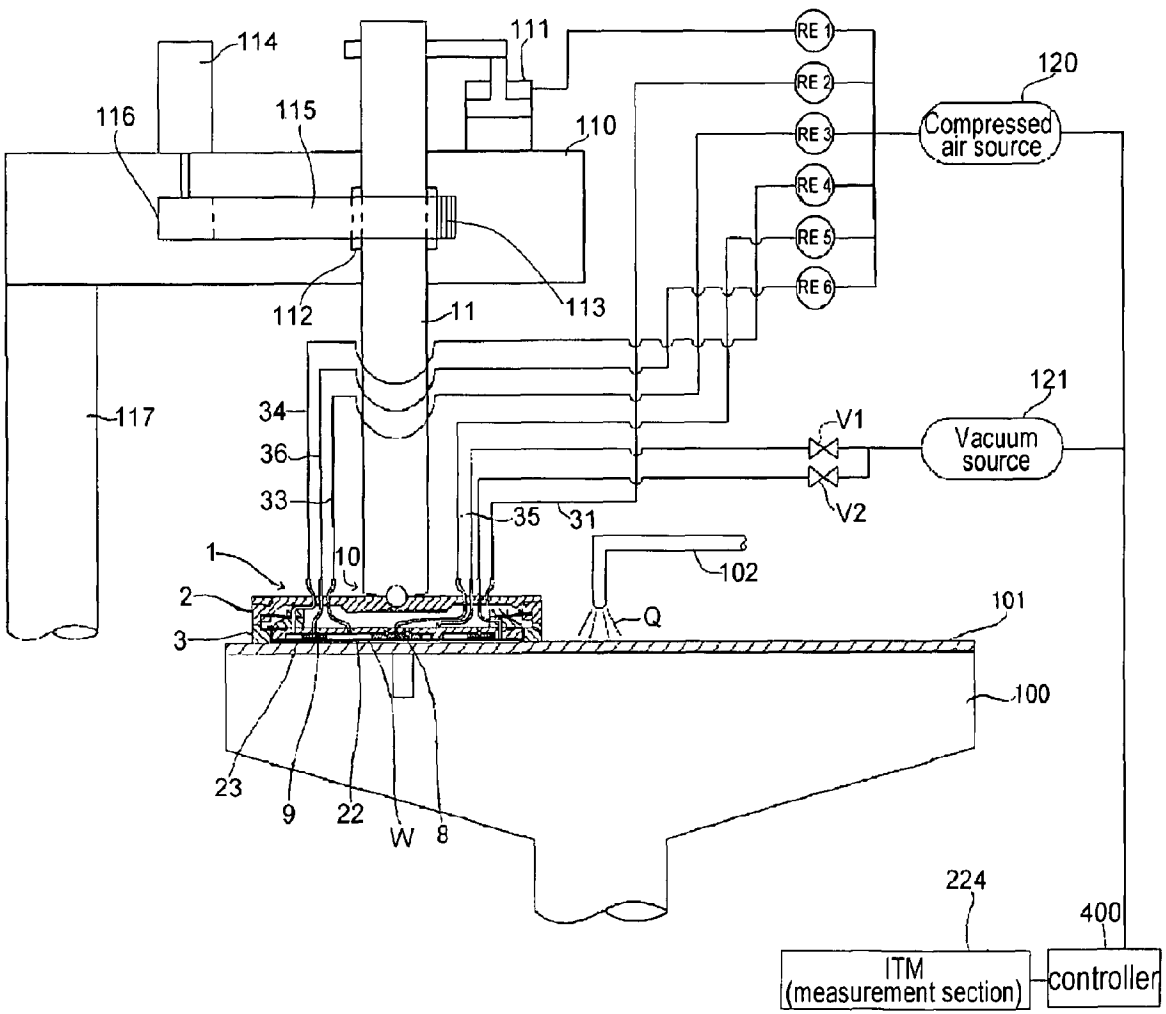
FIG. 2 is a schematic view of a polishing section of the polishing apparatus.

The polishing section of the polishing apparatus holds a substrate such as a semiconductor wafer, a polishing object, and presses the substrate against a polishing surface over a polishing table, thereby flatly polishing the surface of the substrate. As shown in FIG. 2, below the top ring 1 is disposed a polishing table 100 on which is attached a polishing pad (polishing cloth) 101. Above the polishing table 100 is disposed a polishing liquid supply nozzle 102 which supplies a polishing liquid (slurry) Q onto the polishing pad 101 on the polishing table 100. The polishing section is thus constructed.

A polishing liquid having a selectivity is employed as the polishing liquid Q. The selectivity herein refers to a removal rate ratio between a plurality of films, formed in the surface of a substrate, as the films are removed by polishing. For example, for a substrate having a metal film superimposed on an insulating film, the use of a polishing liquid having a high selectivity (high removal rate ratio) between the metal film and the insulating film can solve the problem of over-polishing of the insulating film.

Various commercially-available polishing pads can be used as the polishing pad 101. Examples include SUBA800, IC-1000 and IC-1000/SUBA400 (two-layer cloth), manufactured by Rodel, Inc., and Surfin xxx-5 and Surfin 000, manufactured by Fujimi Incorporated. SUBA800, Surfin xxx-5 and Surfin 000 are non-woven fabrics each comprising fibers fixed with a polyurethane resin, and IC-1000 is a rigid foamed polyurethane (single layer). The foamed polyurethane is porous, having numerous fine recesses or holes in a surface. The polishing pad 101 basically is a consumable member, and gradually wears out as it polishes a surface of a substrate. In an actual polishing process, a polishing pad 101 is replaced with a new one when the polishing pad 101 has come to a predetermined thickness or the polishing rate becomes lower.

The top ring 1 is connected via a universal joint portion 10 to a top ring-driving shaft 11, and the top ring-driving shaft 11 is coupled to a top ring air cylinder 111 secured to a top ring head 110. The top ring-driving shaft 11 moves vertically by the top ring air cylinder 111, thereby moving up and down the entire top ring 1 and pressing a retainer ring 3, fixed to the lower end of a top ring body 2, against the polishing table 100. The top ring air cylinder 111 is connected via a regulator RE1 to a compressed air source 120. The pressure of pressurized air, supplied to the top ring air cylinder 111, can be regulated by the regulator RE1, whereby the pressure of the retainer ring 3 on the polishing pad 101 can be adjusted.

The top ring-driving shaft 11 is mounted via a key (not shown) to a rotating cylinder 112. The rotating cylinder 112 is provided with a timing pulley 113 on its outer portion. A top ring motor 114 as a rotational drive section, which is provided with a timing pulley 116, is secured to a top ring head 110. The timing pulley 113 is connected to the timing pulley 116 via a timing belt 115. Thus, by rotationally driving the top ring motor 114, the rotating cylinder 112 and the top ring-driving shaft 11 rotate integrally by the timing pulley 116, the timing belt 115 and the timing pulley 113, whereby the top ring 1 rotates. The top ring head 110 is supported by a top ring head shaft 117 secured to a frame (not shown).

Though not depicted, the top ring motor 114 is provided with a torque sensor as a measurement section for measuring the torque of the motor 114. For example, when during polishing of a substrate surface, a metal film on the substrate is removed and an insulating film, formed under the metal film, becomes exposed, the torque of the top ring motor 114 changes due to a change in the frictional force between the substrate surface and a polishing surface. The removal of the metal film can be determined by detecting the change with the torque sensor (measurement section). The torque sensor may either be one that actually measures the torque of a motor or one that measures the electric current of a motor. Though in this embodiment the torque sensor is provided in the top ring motor 114, it is also possible to provide a torque sensor as a measurement section in a polishing table motor for rotating the polishing table 100.

Figure 3:
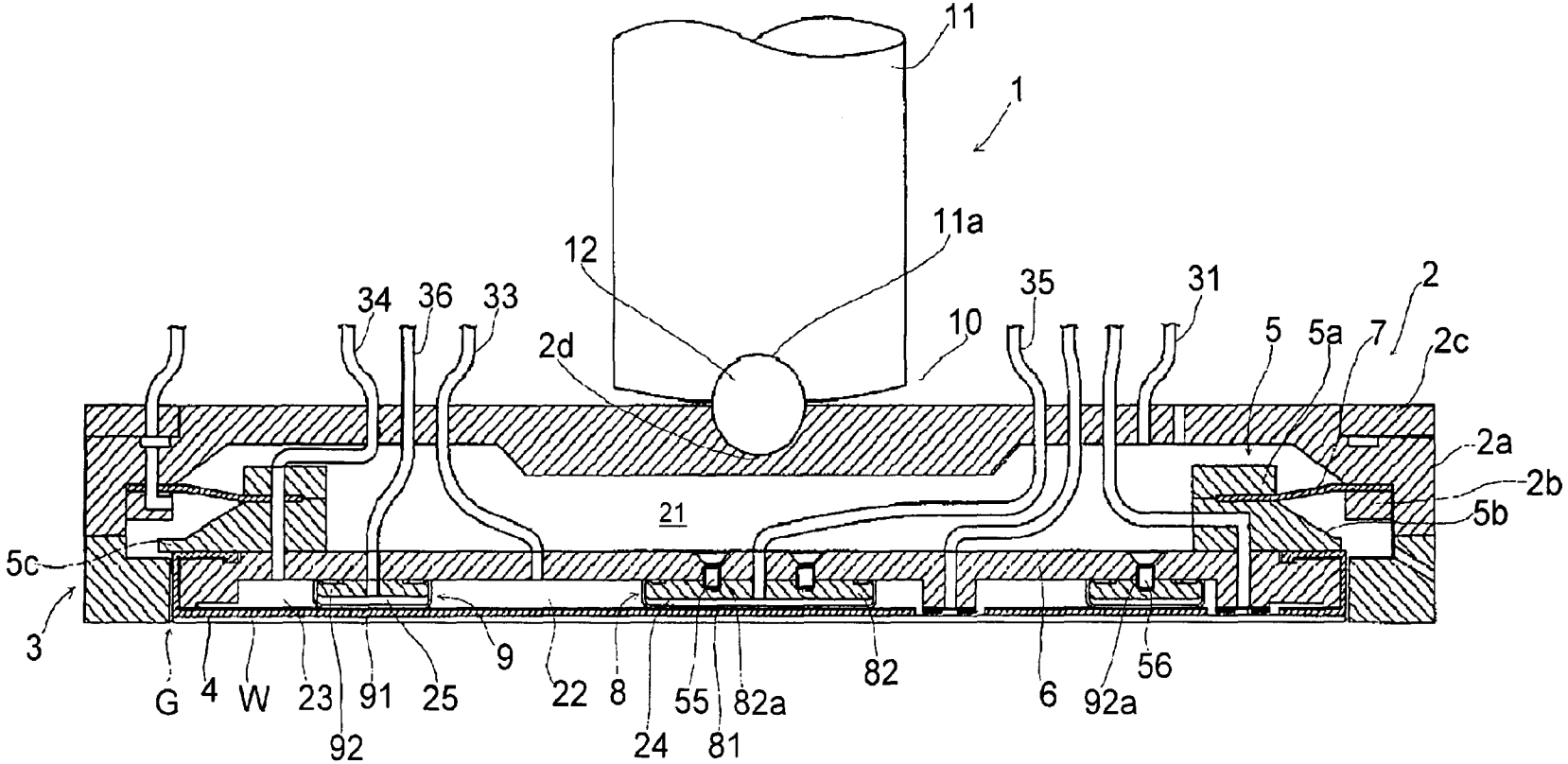
FIG. 3 is a vertical sectional view of a top ring of the polishing apparatus.
Figure 4:
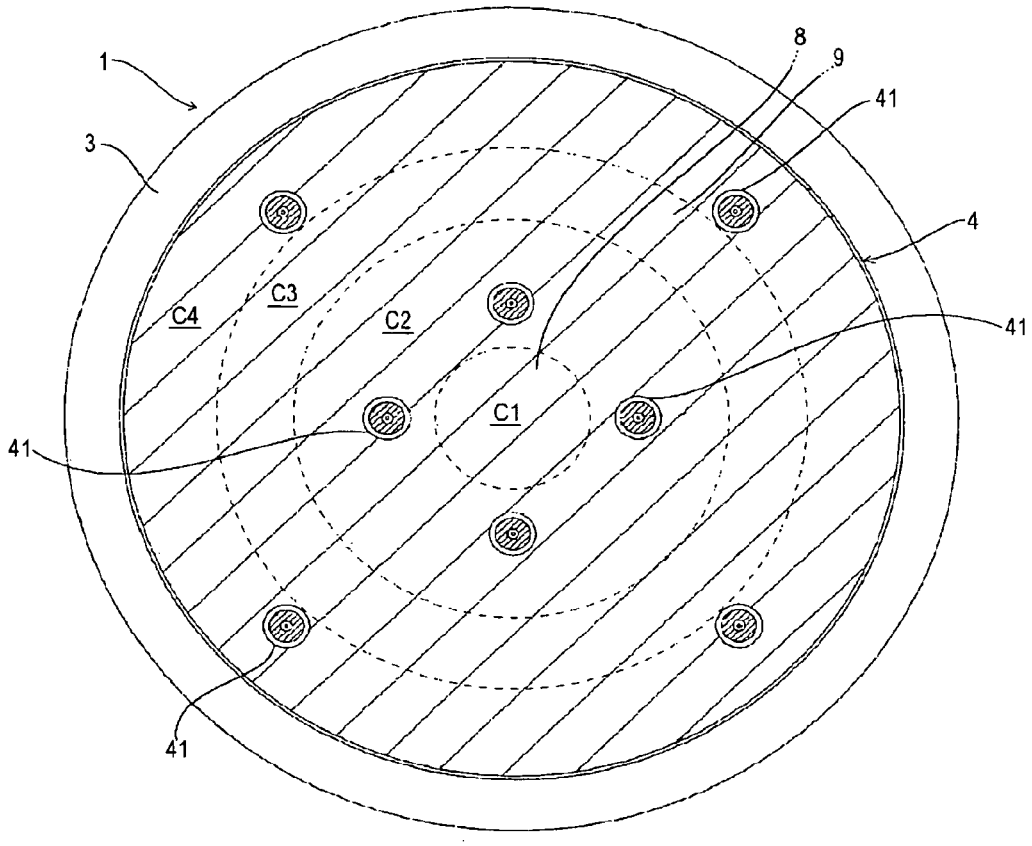
FIG. 4 is a bottom view of the top ring of the polishing apparatus.

The top ring 1 will now be described in more detail with reference to FIGS. 3 and 4. FIG. 3 is a vertical sectional view of the top ring 1, and FIG. 4 is a bottom view of the top ring 1 shown in FIG. 3.

As shown in FIG. 3, the top ring 1 includes a top ring body 2 in the shape of a cylindrical vessel having an internal space therein, and the retainer ring 3 fixed to the lower end of the top ring body 2. The top ring body 2 is formed of, for example, a material having high strength and high rigidity, such as a metal or a ceramic. The retainer ring 3 is formed of, for example, a resin having high rigidity or a ceramic.

The top ring body 2 includes a housing portion 2*a* in the shape of a cylindrical vessel, an annular pressure sheet support portion 2*b* fitted in the cylindrical portion of the housing portion 2*a*, and an annular sealing portion 2*c* fitted into a peripheral portion of the upper surface of the housing portion 2*a*. The lower portion of the retainer ring 3, fixed to the lower surface of the housing portion 2*a* of the top ring body 2, projects inwardly. The retainer ring 3 may be formed integrally with the top ring body 2.

The above-described top ring-drying shaft 11 is provided above the center of the housing portion 2*a* of the top ring body 2. The top ring body 2 and the top ring-driving shaft 11 are coupled by the universal joint portion 10. The universal joint portion 10 includes a spherical bearing mechanism which allows the top ring body 2 and the top ring-driving shaft 11 to tilt with respect to each other, and a rotation transmitting mechanism which transmits the rotation of the top ring-driving shaft 11 to the top ring body 2. Thus, the universal joint portion 10, while permitting tilting of the top ring body 2 with respect to the top ring-driving shaft 11, transmits the pressure and the torque of the top ring-driving shaft 11 to the top ring body 2.

The spherical bearing mechanism is comprised of a spherical recess 11*a* formed in the center of the lower surface of the top ring-driving shaft 11, a spherical recess 2*d* formed in the center of the upper surface of the housing portion 2*a*, and a bearing ball 12 of a high-hardness material, such as a ceramic, interposed between the recesses 11*a*, 2*d*. The rotation transmitting mechanism is comprised of a driving pin (not shown) fixed to the top ring-driving shaft 11, and a driven pin (not shown) fixed to the housing portion 2*a*. The driving pin and the driven pin are vertically movable relative to each other. Accordingly, even when the top ring body 2 is tilted, the pins still engage each other each at a shifted contact point. The rotation transmitting mechanism thus securely transmits the rotary torque of the top ring-driving shaft 1 to the top ring body 2.

In the interior space defined by the top ring body 2 and the retainer ring 3 fixed integrally to the top ring body 2, there are housed an elastic pad 4 to be in contact with a substrate W, such as a semiconductor wafer, held by the top ring 1, an annular holder ring 5, and a generally disk-shaped chucking plate 6 for supporting the elastic pad 4. The elastic pad 4 is nipped, at its peripheral portion, between the holder ring 5 and the chucking plate 6 fixed to the lower end of the holder ring 5, and covers the lower surface of the chucking plate 6. A space is thus formed between the elastic pad 4 and the chucking plate 6.

A pressure sheet 7, composed of an elastic film, is stretched between the holder ring 5 and the top ring body 2. The pressure sheet 7 is fixed with its one end nipped between the housing portion 2*a* and the pressure sheet support portion 2*b* of the top ring body 2, and the other end nipped between an upper end portion 5*a* and a stopper portion 5*b* of the holder ring 5. A pressure chamber 21 is formed inside the top ring body 2 by the top ring body 2, the chucking plate 6, the holder ring 5 and the pressure sheet 7. As shown in FIG. 3, a fluid passage 31, e.g., comprised of a tube and a connector, communicates with the pressure chamber 21. The pressure chamber 21 is connected to the compressed air source 120 via a regulator RE2 provided in the fluid passage 31. The pressure sheet 7 is formed of, for example, a rubber material having excellent strength and durability, such as ethylene-propylene rubber (EPDM), polyurethane rubber, or silicon rubber.

In case the pressure sheet 7 is formed of an elastic material, such as a rubber, and is fixed by nipping it between the retainer ring 3 and the top ring body 2, because of the elastic deformation of the elastic pressure sheet 7, a desirable flat plane may not be obtained in the lower surface of the retainer ring 3. In view of this, the pressure sheet support portion 2*b* is separately provided, according to this embodiment, so as to nip and fix the pressure sheet 7 between the housing portion 2*a* and the pressure sheet support portion 2*b* of the top ring body 2.

It is also possible to make the retainer ring 3 vertically movable relative to the top ring body 2 or to make the retainer ring 3 pressable independent of the top ring body 2, as disclosed in Japanese Patent Application No. H8-50956 (Laid-Open Publication No. H9-168964) or Japanese Patent Application No. H11-294503. In such a case, the above-described fixing method for the pressure sheet 7 may not necessarily be employed.

A center bag 8 (central contact member) and a ring tube 9 (outer contact member), which are contact members to be in contact with the elastic pad 4, are provided in the space formed between the elastic pad 4 and the chucking plate 6. As shown in FIGS. 3 and 4, in this embodiment, the center bag 8 is disposed in the center of the lower surface of the chucking plate 6, and the ring tube 9 is disposed outside of the center bag 8 such that it surrounds the center bag 8. As with the pressure sheet 7, the elastic pad 4, the center bag 8 and the ring tube 9 are formed of, for example, a rubber material having excellent strength and durability, such as ethylene-propylene rubber (EPDM), polyurethane rubber, or silicon rubber.

The space formed between the chucking plate 6 and the elastic pad 4 is divided by the center bag 8 and the ring tube 9 into the following chambers: a pressure chamber 22 formed between the center bag 8 and the ring tube 9; and a pressure chamber 23 formed outside the ring tube 9.

The center bag 8 is comprised of an elastic film 81, which is in contact with the upper surface of the elastic pad 4, and a center bag holder 82 (holding portion) detachably holding the elastic film 81. The center bag holder 82 has screw holes 82*a*, and the center bag 8 is detachably mounted to the center of the lower surface of the chucking plate 6 by screwing screws 55 into the screw holes 82*a*. The center bag 8 internally has a central pressure chamber 24 defined by the elastic film 81 and the center bag holder 82.

Similarly, the ring tube 9 is comprised of an elastic film 91, which is in contact with the upper surface of the elastic pad 4, and a ring tube holder 92 (holding portion) detachably holding the elastic film 91. The ring tube holder 92 has screw holes 92*a*, and the ring tube 9 is detachably mounted to the lower surface of the chucking plate 6 by screwing screws 56 into the screw holes 92*a*. The ring tube 9 internally has an intermediate pressure chamber 25 defined by the elastic film 91 and the ring tube holder 92.

Fluid passages 33, 34, 35, 36, each comprised of, e.g., a tube and a connector, communicate with the pressure chambers 22, 23, the central pressure chamber 24 and the intermediate pressure chamber 25, respectively. The pressure chambers 22-25 are connected to the compressed air source 120 as a supply source via regulators RE3, RE4, RE5, RE6 respectively provided in the fluid passages 33-36. The above-described fluid passages 31, 33-36 are connected to the respective regulators RE2-RE6 via rotary joints (not shown) provided at the upper end of the top ring-driving shaft 11.

A pressurized fluid, such as pressurized air, or atmospheric pressure or vacuum is supplied to the above-described pressure chamber 21, lying over the chucking plate 6, and to the pressure chambers 22-25 through the fluid passages 31, 33-36 communicating with the pressure chambers. As shown in FIG. 2, the pressures of pressurized fluids to be supplied to the pressure chambers 21-25 can be adjusted by the regulators RE2-RE6 provided in the fluid passages 31, 33-36 for the pressure chambers 21-25. The pressures in the pressure chambers 21-25 can thus be controlled independently or can be brought to atmospheric pressure or vacuum.

By thus making the pressures in the pressure chambers 21-25 independently variable by the regulators RE2-RE6, it becomes possible to adjust the pressure of the elastic pad 4 on the substrate W, and thus the pressure of the substrate W on the polishing pad 4, independently for divisional portions (divisional areas) of the substrate W. In some cases, the pressure chambers 21-25 may be connected to a vacuum source 121.

The operation of the top ring 1 having the above construction upon polishing will now be described. When carrying out polishing of a substrate W, the substrate W is held on the lower surface of the top ring 1 while the top ring air cylinder 111, coupled to the top ring-driving shaft 11, is actuated to press the retainer ring 3, fixed to the lower end of the top ring 1, against the polishing pad 101 of the polishing table 100 at a predetermined pressure. Pressurized fluids at predetermined pressures are respectively supplied to the pressure chambers 22, 23, the central pressure chamber 24 and the intermediate pressure chamber 25 to press the substrate W against the polishing pad 101 of the polishing table 100. A polishing liquid Q is supplied from the polishing liquid supply nozzle 102 onto the polishing pad 101, and the polishing liquid Q is held on the polishing pad 101. Polishing of the lower surface of the substrate W is thus carried out with the polishing liquid Q present between the surface (lower surface) to be polished of the substrate W and the polishing pad 101.

The portions of the substrate W, which lie underneath the pressure chambers 22, 23, are pressed against a polishing surface by the pressures of pressurized fluids respectively supplied to the pressure chambers 22, 23. The portion of the substrate W, which lies underneath the central pressure chamber 24, is pressed against the polishing surface, via the elastic film 81 of the center bag 8 and the elastic pad 4, by the pressure of a pressurized fluid supplied to the central pressure chamber 24. The portion of the substrate W, which lies underneath the intermediate pressure chamber 25, is pressed against the polishing surface, via the elastic film 91 of the ring tube 9 and the elastic pad 4, by the pressure of a pressurized fluid supplied to the intermediate pressure chamber 25.

Accordingly, the polishing pressure applied to the substrate W can be adjusted individually for the divisional portions, divided along the radial direction, of the substrate W by controlling the pressures of pressurized fluids respectively supplied to the pressure chambers 22-25. In particular, a below-described controller (control section) 400 controls the pressures of pressurized fluids, respectively supplied to the pressure chambers 22-25, independently by the regulators RE3-RE6, thereby adjusting the pressures of the substrate W on the polishing pad 101 of the polishing table 100 independently for the divisional portions of the substrate W. The substrate W can thus be pressed against the polishing pad 101 on the upper surface of the rotating polishing table 100 with the polishing pressure adjusted to a desired value for each divisional portion of the substrate W. Similarly, the pressure of a pressurized fluid supplied to the top ring air cylinder 111 can be adjusted by the regulator RE1 so as to change the pressure of the retainer ring 3 on the polishing pad 101.

By thus appropriately adjusting, during polishing, the pressure of the retainer ring 3 on the polishing pad 101 and the pressure of the substrate W on the polishing pad 101, a desired distribution of polishing pressure can be obtained over the center portion of the substrate W (portion C1 shown in FIG. 4), the center to intermediate portion (C2), the intermediate portion (C3) and the peripheral portion (C4), and the retainer ring 3 lying outside the substrate W.

In the portions of the substrate W which lie underneath the pressure chambers 22, 23, there are a portion to which a pressure is applied via the elastic pad 4 from a pressurized fluid and a portion, such as a portion corresponding to an opening 41, to which the pressure of the pressurized fluid is directly applied. The pressures applied to these portions may be equal or different from each other. The elastic pad 4 around an opening 41 adheres tightly to the back surface of the substrate W during polishing. Therefore, the pressurized fluids in the pressure chambers 22, 23 seldom leak out.

The substrate W can thus be divided into four concentric circular and annular portions (C1-C4), and those portions (areas) can be pressed at independent pressures. The polishing rate depends on the pressure of the substrate W on a polishing surface and, as described above, the pressure of each divisional portion of the substrate W can be controlled independently. It thus becomes possible to independently control the polishing rates of the four portions (C1-C4) of the substrate W. Accordingly, even when there is a radial variation in a thickness of a surface film to be polished of the substrate W, shortage of polishing or over-polishing can be avoided over the entire substrate surface.

In particular, even when a thickness of a surface film to be polished of the substrate W varies in the radial direction of the substrate W, the pressure of a portion of the substrate W, having a relatively large film thickness, on a polishing surface can be made higher than the pressure of a portion of the substrate W, having a relatively small film thickness, on the polishing surface by making the pressures of those pressure chambers of the pressure chambers 22-25, which lie over the portion of the substrate W having a relatively large film thickness, higher than the pressures of the other pressure chambers, or by making the pressures of those pressure chambers, which lie over the portion of the substrate W having a relatively small film thickness, lower than the pressures of the other pressure chambers. The polishing rate of the portion of the substrate W having a relatively large film thickness can thus be selectively raised. This makes it possible to polish the surface of the substrate W without excess or shortage of polishing over the entire surface irrespective of the thickness distribution of a surface film upon its formation.

The phenomenon of over-polishing of edge, which can occur in the edge portion of the substrate W, can be prevented by controlling the pressure of the retainer ring 3. Further, when there is a large change in a thickness of a film to be polished in the edge portion of the substrate W, the polishing rate of the edge portion of the substrate W can be controlled by making the pressure of the retainer ring 3 high or low intentionally. When pressurized fluids are supplied to the pressure chambers 22-25, the chucking plate 6 receives an upward force. According to this embodiment, a pressurized fluid is supplied through the fluid passage 31 into the pressure chamber 21 to prevent the chucking plate 6 from being lifted up by the force applied from the pressure chambers 22-25.

Polishing of the substrate W is thus carried out while appropriately adjusting the pressure of the retainer ring 3 on the polishing pad 101 by the top ring air cylinder 111 and the pressures of the divisional portions of the substrate W on the polishing pad 101 with pressurized airs supplied to the pressure chambers 22-25, as described above.

As described hereinabove, the pressure on a substrate can be controlled by independently controlling the pressures in the pressure chambers 22, 23, the pressure chamber 24 in the center bag 8, and the pressure chamber 25 in the ring tube 9. Further according to this embodiment, a particular area of a substrate, for which pressure control is carried out, can be easily changed by changing the position, size, etc. of the center bag 8 and the ring tube 9.

In particular, a thickness distribution of a film formed on a surface of a substrate may vary depending on the film-forming method, the type of the film-forming apparatus used, and the like. According to this embodiment, the position and the size of a pressure chamber for applying a pressure on a substrate can be changed simply by changing the center bag 8 and the center bag holder 82, or the ring tube 9 and the ring tube holder 92. Thus, a region of a substrate to carry out pressure control can be changed according to a thickness distribution of a film to be polished easily at a low cost simply by changing only a part of the top ring 1. In other words, this makes it possible to deal with a change in a thickness distribution of a surface film to be polished of a substrate easily at a low cost. It is to be noted that changing the shape and the position of the center bag 8 or the ring tube 9 should necessarily change the size of the pressure chamber 22, lying between the center bag 8 and the ring tube 9, and the size of the pressure chamber 23 surrounding the ring tube 9.

On a substrate as a polishing object by this polishing apparatus is formed, for example, a copper plated film for forming interconnects, and a barrier layer underlying the plated film. When an insulating film of, e.g., silicon oxide is formed as the topmost layer of a substrate as a polishing object by this polishing apparatus, a thickness of the insulating film can be detected with an optical sensor or a microwave sensor. A halogen lamp, a xenon flash lamp, an LED or a laser light source can be used as the light source of the optical sensor.

A polishing method as executed by the controller 400 of the polishing apparatus according to the present invention will now be described in greater detail.

Figure 5:
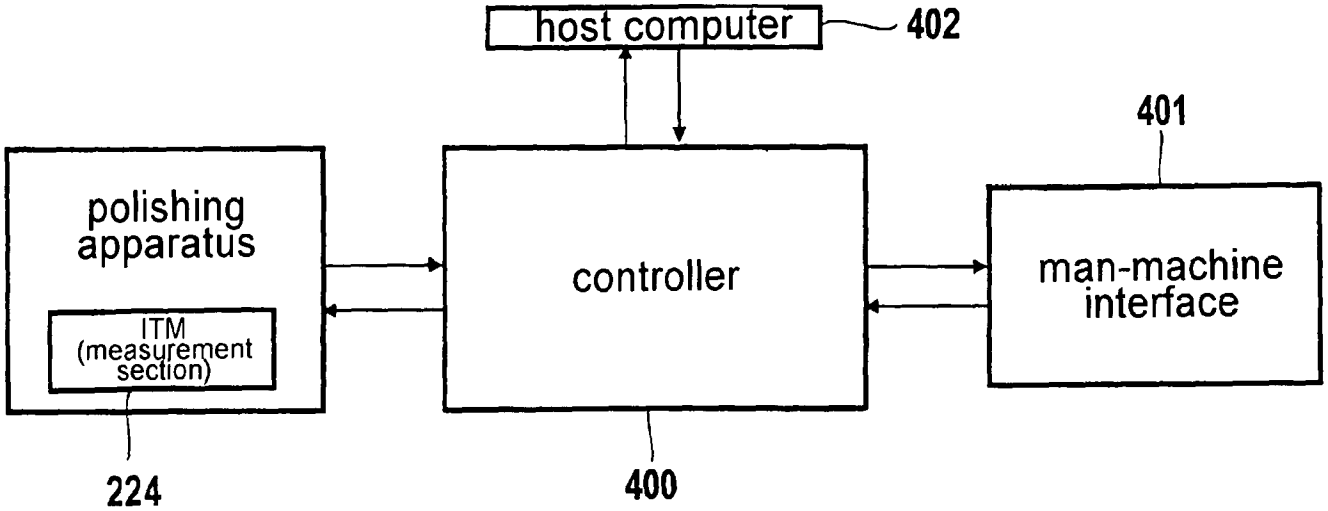
FIG. 5 is a control block diagram of the polishing apparatus.

As shown in FIG. 5, the controller 400 controls the polishing apparatus so as to polish the substrate W at a target polishing rate (polishing amount) which will provide a target profile, such as a desired configuration of a polished surface, based on an input from a man-machine interface 401, such as an operation panel, and an input from a host computer 402 which performs various data processings. Polishing recipes for various types of films as polishing objects, formed on a substrate, are stored in a database 404 (see, e.g., FIG. 6). The controller 400 obtains information on the types of films, formed in the surface of the substrate W stored in the cassette 204, from a recording medium, such as a bar code, provided in the cassette 204, reads out corresponding polishing conditions (polishing recipe) from the database 404, and automatically prepares a polishing recipe for each of the areas C1-C4 of the substrate W.

The substrate after completion of the polishing process carried out according to the polishing recipe is cleaned and dried, and is then transferred to the ITM 224 to measure the surface conditions, such as a thickness of a film, the level difference in surface irregularities, etc., of the substrate after polishing. The results of the measurement are fed back to modify (renew) the polishing conditions (polishing recipe) so that the polishing process can be repeated under the optimum conditions.

A polishing process is normally carried out while taking substrates W out of the cassette 204 sequentially after commencement of the process. However, in cases where a polishing recipe needs to be modified upon commencement of the polishing process, for example, when resuming the polishing process after a long period of rest, when polishing the first substrate in the cassette, or when consumable members, such as the polishing pad 101, the dresser, the polishing liquid, the retainer ring in the top ring, a packing film, a membrane, etc., have just been replaced with new ones, only the first substrate is fed to the polishing table to polish the substrate upon commencement of the polishing process, whereas the successive feeding of the second and following substrates is halted until the first substrate after polishing is measured by the ITM. Such an operation of shutting off the flow of feeding substrates is called "gating".

Figure 6:
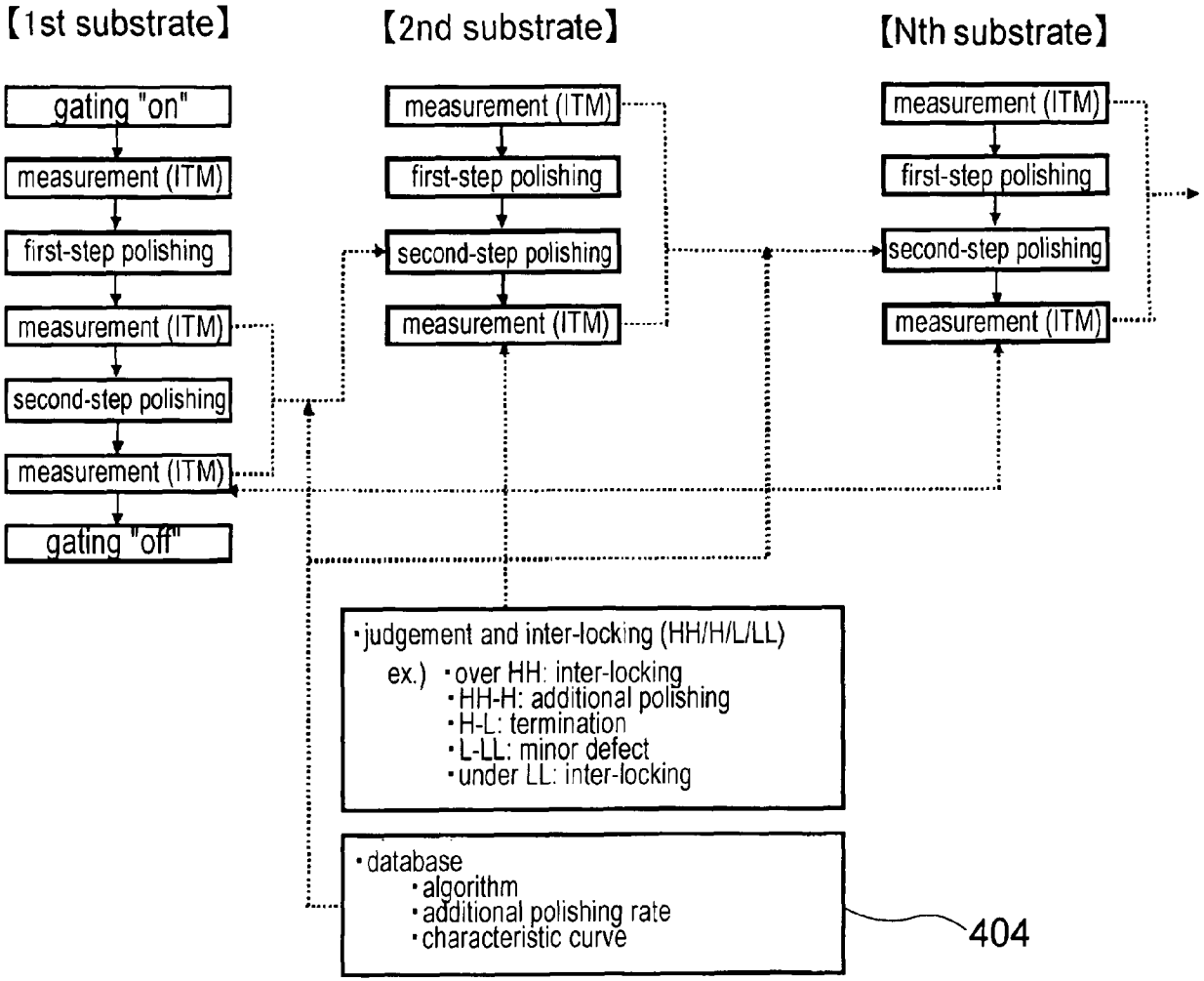
FIG. 6 is a diagram showing an embodiment of a polishing process using gating.

A polishing process using gating, according to an embodiment of the present invention, will now be described with reference to FIG. 6. First, gating is executed (gating "on") based on an input from the man-machine interface 401, such as an operation panel, and an input from the host computer 402, which performs various data processings to the controller 400. Subsequently to the gating, the host computer 402 issues a command to relevant sections in the polishing apparatus to carry out the following polishing process:

As shown in FIG. 6, the first substrate taken out of the cassette is first transported to the ITM 224, where the surface conditions, such as a thickness of a film, of the substrate in the initial state before polishing are measured. Next, first-step polishing of the surface of the substrate is carried out under preset polishing conditions (polishing recipe). The substrate after completion of the first-step polishing is cleaned, followed by drying, and is again transported to the ITM 224, where the surface conditions, such as a thickness of a film, of the substrate after the first-step polishing are measured. Thereafter, second-step polishing of the surface of the substrate is carried out according to a preset polishing recipe. The substrate after completion of the second-step polishing is cleaned, followed by drying, and is against transported to the ITM 224, where the surface conditions, such as a thickness of a film, of the substrate after the second-step polishing are measured. The substrate after the measurement is returned to the cassette. The polishing process for the first substrate is thus completed, and the gating is terminated (gating "off").

The second substrate is then taken out of the cassette, and the second substrate is first transported to the ITM 224, where the surface conditions, such as a thickness of a film, of the substrate in the initial state before polishing are measured. Next, first-step polishing of the substrate surface is carried out according to a predetermined polishing recipe and, successively, second-step polishing of the substrate surface is carried out according to a polishing recipe. Thus, the substrate after completion of the first-step polishing is not transported to the ITM for measurement of the surface conditions. The substrate after completion of the second-step polishing is cleaned, followed by drying, and is again transported to the ITM 224, where the surface conditions, such as a thickness of a film, of the substrate after the second-step polishing are measured. The substrate after the measurement is returned to the cassette. The polishing process for the second substrate is thus completed.

The polishing recipe (polishing conditions) for the second-step polishing of the second substrate is optimally modified (renewed) based on the results of the measurement with the ITM 224 of the surface conditions, such as a thickness of a film, of the first substrate, carried out before and after the second-step polishing, that is, by feedback of the results of the measurement of the surface conditions.

The third or later substrate (Nth substrate) taken out of the cassette is first transported to the ITM 224, where the surface conditions, such as a thickness of a film, of the substrate in the initial state before polishing are measured. Next, first-step polishing of the substrate surface is carried out according to a predetermined polishing recipe and, successively, second-step polishing of the substrate surface is carried out according to a polishing recipe. Thus, the substrate after completion of the first-step polishing is not transported to the ITM 224 for measurement of the surface conditions. The substrate after completion of the second-step polishing is cleaned, followed by drying, and is again transported to the ITM 224, where the surface conditions, such as a thickness of a film, of the substrate after the second-step polishing are measured. The substrate after the measurement is returned to the cassette. The polishing process for the third or later substrate is thus completed.

The polishing recipe (polishing conditions) for the second-step polishing of the third or later substrate is optimally modified (renewed) based on the results of the measurement with the ITM 224 of the surface conditions, such as a thickness of a film, of the preceding substrate, carried out before the first-step polishing, i.e., on the substrate in the initial state, and after the second-step polishing, that is, by feedback of the results of the measurement of the surface conditions.

In this embodiment the polishing conditions (polishing recipe) for the first-step polishing are fixed and the first-step polishing is carried out with the same recipe for all the substrate, and only the polishing conditions for the second-step polishing are modified (renewed) for optimization based on the results of measurement on the preceding substrate. It is also possible to hold, throughout the polishing process, a measured value of the surface conditions, such as a thickness of a film, of the first substrate in the initial state before polishing, and use the measured value, without change, for the second and following substrates without measuring the surface conditions of the substrates in their initial states. Though the two-step polishing process is carried out in this embodiment, a polishing process comprising three or more steps can be carried out in a similar manner. The above description of the polishing conditions for the second-step polishing will apply to polishing conditions for a predetermined (preset) step or steps in such a multi-step polishing process. Further, the above description of the polishing conditions for the second-step polishing will not apply only to polishing conditions for the second or later step. Thus, it is possible to modify polishing conditions for the first step in the same manner as described above with reference to the second step. This holds also for the below-described embodiment.

By thus carrying out the first-step polishing and the second-step polishing of the second or later substrate, taken out of a cassette, successively without measuring, e.g., with an ITM the surface conditions, such as a thickness of a film, of the substrate after completion of the first-step polishing, it becomes possible to omit the measurement with an ITM, thereby increasing the throughput. Furthermore, by modifying (renewing) the polishing conditions for the second step based on the results of measurement carried out on the latest processed substrate, the second-step polishing can be carried under the optimum polishing conditions.

In this embodiment the controller 400 further performs the following control. More specifically, in the polishing apparatus is stored the database 404 in which is stored data concerning polishing, such as data on the relationship between polishing time and polishing amount, data on the degree of wear of the polishing pad, the number of substrates to be subjected to additional polishing (re-work), data on the surface temperature of the polishing pad, data on the degree of wear of the dresser, etc. Additional polishing herein refers to a process of re-polishing a substrate, as carried out when measurement of the substrate surface with the ITM 224 after polishing of the substrate has revealed insufficient removal of a film which is a polishing object. The data in the database 404 is used when modifying a polishing recipe for a step of a multi-step polishing process.

For example, the degree of wear of the polishing pad 101 is proportional to the number of substrates W polished with the polishing pad 101. In the database is stored data on the counted number of substrates which have been polished since the latest replacement of the old polishing pad 101 with a new one. Based on the data, the polishing recipe, the frequency and the time of dressing with the dresser, etc. are modified. It is also possible to actually measure the degree of wear of the polishing pad 101 by irradiating the polishing surface with light, ultrasonic waves, or the like.

The database determines the incidence rate of additional polishing by counting the number of substrates to be subjected to additional polishing and, when the incidence rate of additional polishing is higher than a set value preset, e.g., from the man-machine interface 401, executes gating (gating "on") and again carries out the above-described polishing process carried out on the first substrate.

Besides the incidence rate of additional polishing, the number of additional polishing operations, the level difference in irregularities on a polished surface of a substrate, the average or deviation of the polishing amounts of polished substrates, and the upper or lower limit of a pre-input polishing amount can be used as parameters for executing the gating.

The following is an additional polishing process using gating. Additional polishing is carried out repeatedly until a film to be polished is completely removed, or removed to a predetermined thickness. More specifically, after carrying out additional polishing of a substrate (wafer), the surface of the substrate is measured with an ITM. When the measurement reveals incomplete removal of a target film, the substrate is again subject to additional polishing.

According to the present invention, in order to decrease the number of additional polishing operations, the following additional polishing process is carried out. Gating is executed on the first substrate (gating "on"), and additional polishing is carried out under preset polishing conditions (polishing recipe). The substrate after the additional polishing is cleaned, followed by drying, and is transported to the ITM 224 to measure the surface conditions, such as a thickness of a film, of the substrate after polishing. The substrate is returned to the cassette when the removal of the film, as determined by the measurement, satisfies a set value, whereas the substrate is again subjected to additional polishing when the removal of the film does not satisfy the set value. The additional polishing process is completed when the removal of the film has come to satisfy the set value, and gating is terminated.

For the second or later substrate, the polishing recipe is modified based on the surface conditions (a thickness of a film, etc.) of the substrate and the results of polishing of the first substrate, and additional polishing of the substrate is carried out according to the modified polishing recipe. After the additional polishing, the substrate is cleaned and dried, and is transported to the ITM 224 to measure the surface conditions, such as a thickness of a film, of the substrate after polishing. The polishing conditions are fed back to a polishing recipe for the next third substrate.

Figure 7:
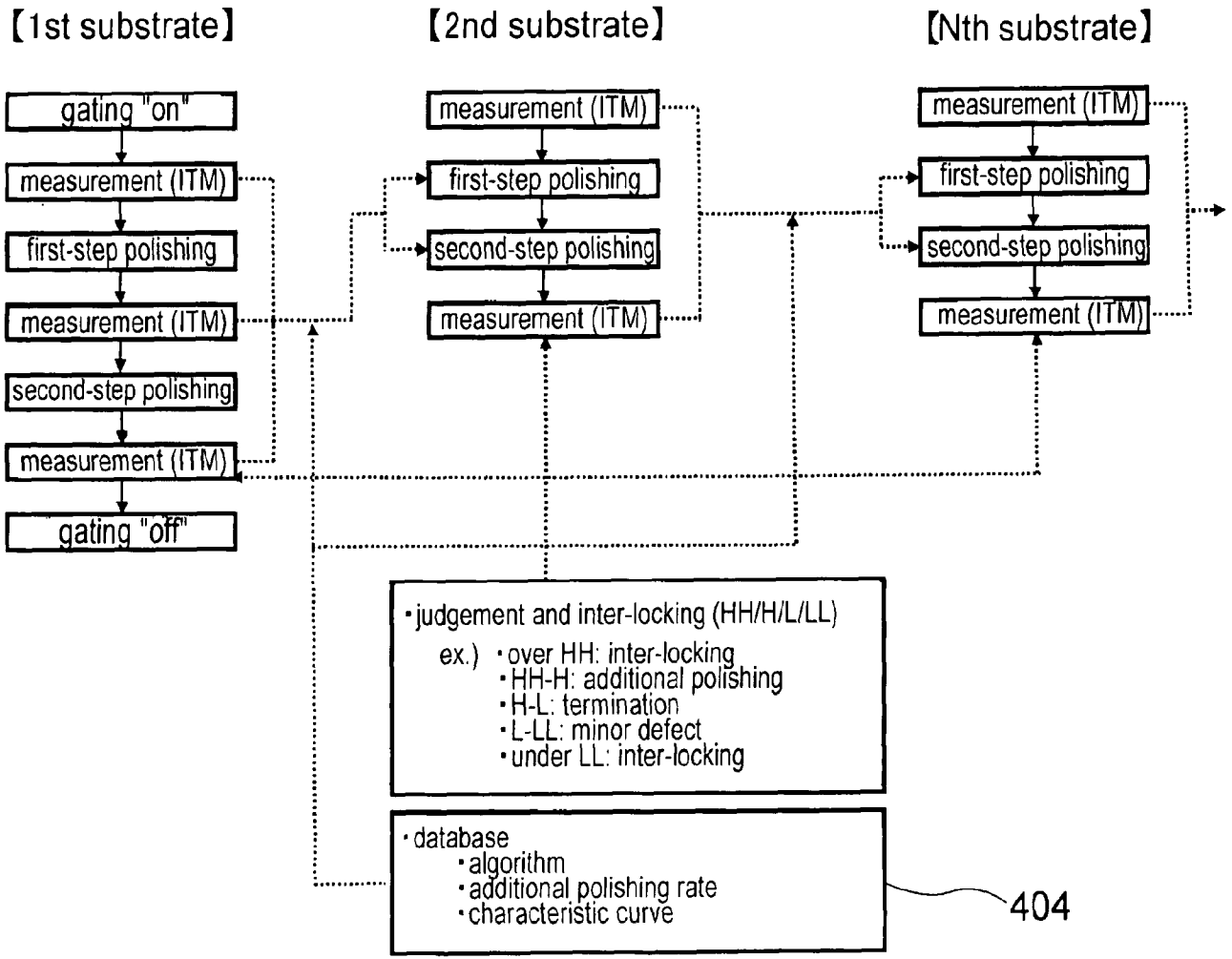
FIG. 7 is a diagram showing an embodiment of an additional polishing process using gating.
Figure 8A:
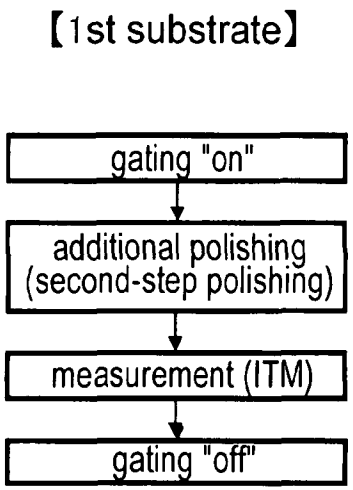
FIGS. 8A through 8C are diagrams showing another embodiment of the polishing process using gating.
Figure 8B:
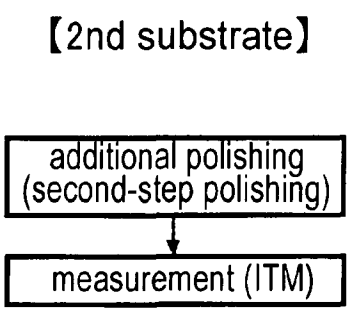
Figure 8C:
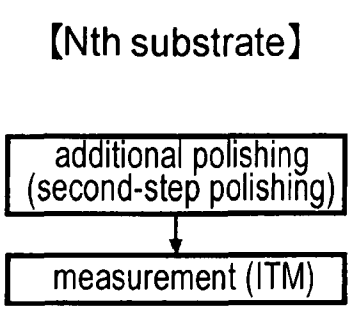

FIG. 7 shows a polishing process using gating, according to another embodiment of the present invention. The polishing process of this embodiment is an alternative to the preceding embodiment shown in FIG. 6, and differs from the preceding embodiment in the following respects: In this embodiment, the same gating as in the preceding embodiment is carried out on the first substrate taken out of the cassette. The second substrate, taken out of the cassette, is first transported to the ITM 224, where the surface conditions, such as a thickness of a film, of the substrate in the initial state before polishing are measured. Next, first-step polishing and second-step polishing of the surface of the substrate are carried out successively under their respective polishing conditions (polishing recipes). The substrate after completion of the second-step polishing is cleaned, followed by drying, and is again transported to the ITM 224, where the surface conditions, such as a thickness of a film, of the substrate after the second-step polishing are measured. The substrate after the measurement is returned to the cassette.

The polishing recipe (polishing conditions) for at least one of the first-step polishing and the second-step polishing of the second substrate taken out of the cassette are renewed (modified) by feedback of the results of the measurement with the ITM 224 of the surface conditions, such as a thickness of a film, of the first substrate before and after the second-step polishing.

The third or later substrate, taken out of the cassette, is first transported to the ITM 224, where the surface conditions, such as a thickness of a film, of the substrate in the initial state before polishing are measured. Next, first-step polishing and second-step polishing of the substrate surface are carried out successively according to their respective polishing recipes. The substrate after completion of the second-step polishing is cleaned, followed by drying, and is again transported to the ITM 224, where the surface conditions, such as a thickness of a film, of the substrate after the second-step polishing are measured. The substrate after the measurement is returned to the cassette.

The polishing recipe (polishing conditions) of at least one of the first-step polishing and the second-step polishing of the third or later substrate taken out of the cassette are renewed (modified) by feedback of the results of the measurement with the ITM 224 of the surface conditions, such as a thickness of a film, of the preceding substrate in the initial state and after the second-step polishing.

For example, when the incidence rate of additional polishing has become higher than a set value, the rate can be lowered by changing the manner of feeding back the date such that the polishing step to which the data is fed back is shifted from only to the second-step polishing, as shown in FIG. 6, to the first-step polishing or both of the first-step polishing and second-step polishing, as shown in FIG. 7.

In this embodiment various determinations, such as determination as to whether to obtain data, e.g., on a thickness of a film, for the second or later substrate, determination as to whether to execute re-gating, determination as to how to feed back, etc., are made autonomously by programs mainly recorded in the host computer 402, though determination by the worker is also possible.

By carrying out control also taking account of changes in the circumstances and conditions around a substrate surface, as described above, it becomes possible to perform a polishing operation with higher precision as compared to a control method of feeding back only the surface conditions of a substrate to improve a polishing recipe. The control method of feeding back only the surface conditions of a substrate solely utilizes the results of polishing. On the other hand, the control method of carrying out control by taking account of changes in the circumstances and conditions around a substrate surface, in addition to feedback of the surface conditions of the substrate, utilizes as parameters both the cause and the results for a profile of substrate surface after polishing, which enables good polishing operation. This control method is based on a control method called APC (advanced process control) or EES (equipment engineering system).

The ITM 224 used in the above embodiments is of an optical type. Thus, when a film, a polishing object, formed in a substrate surface is a metal, the thickness of the film cannot be measured with the ITM 224 because of total reflection of light incident upon the film. Accordingly, the ITM 224 is applicable only to a nonmetallic film, such as an insulating film. Though the two-step polishing processes are carried out in the above embodiments, the present invention is applicable also to a multi-step polishing process of three or more steps. In the case of such a multi-step polishing process, data may be fed back to an increased number of combinations of steps (for example, to the first, second, third and fourth steps, only to the third step, etc.), and an appropriate manner of feedback may be chosen using parameters, such as the history of the results of polishing, the type of the target film, the type of the polishing liquid used, etc.

Figure 9A:
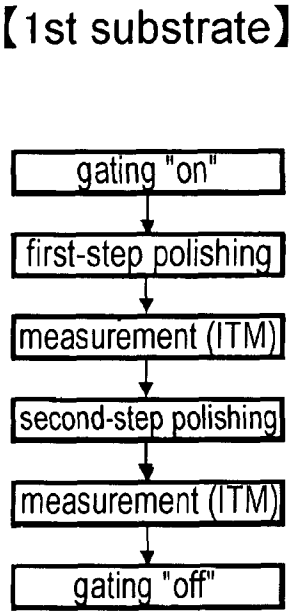
FIGS. 9A through 9C are diagrams showing an embodiment of another polishing process using gating.
Figure 9B:
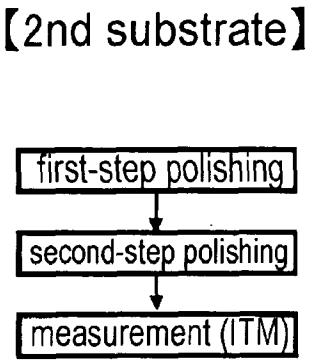
Figure 9C:
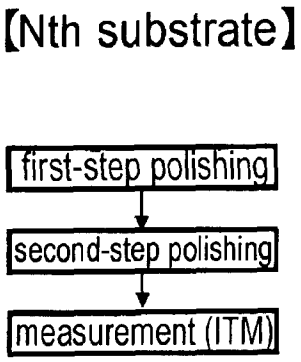
Figure 10:
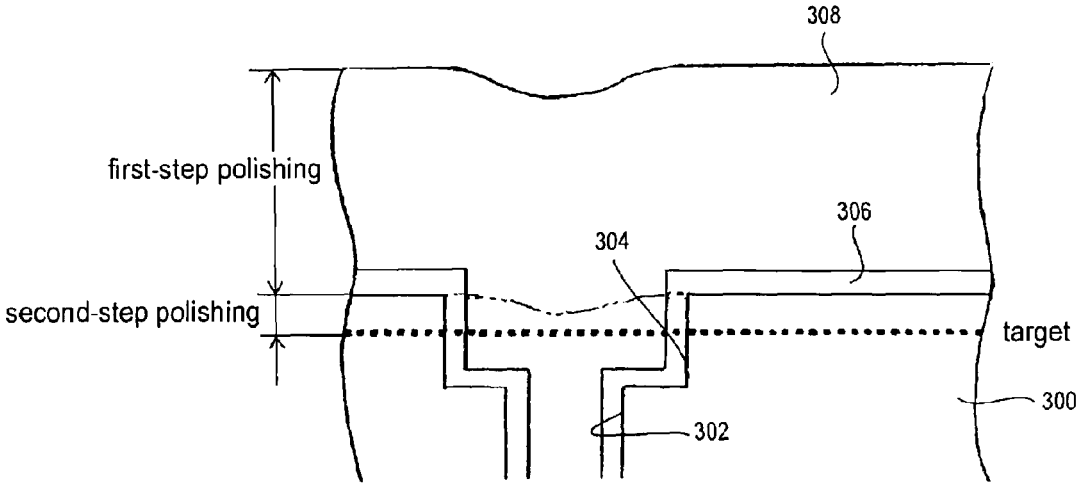
FIG. 10 is a diagram illustrating polishing in the polishing process shown in FIGS. 9A through 9C.
Figure 11A:
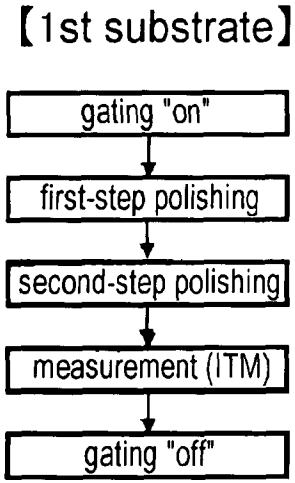
FIGS. 11A through 11C are diagrams showing another embodiment of another polishing process using gating, according to yet another embodiment of the present invention.
Figure 11B:
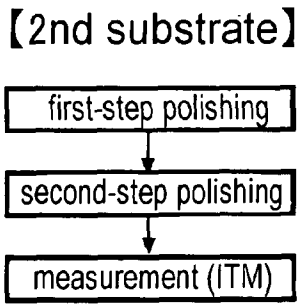
Figure 11C:
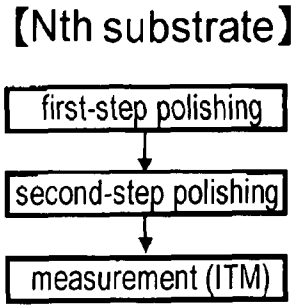
Figure 12:
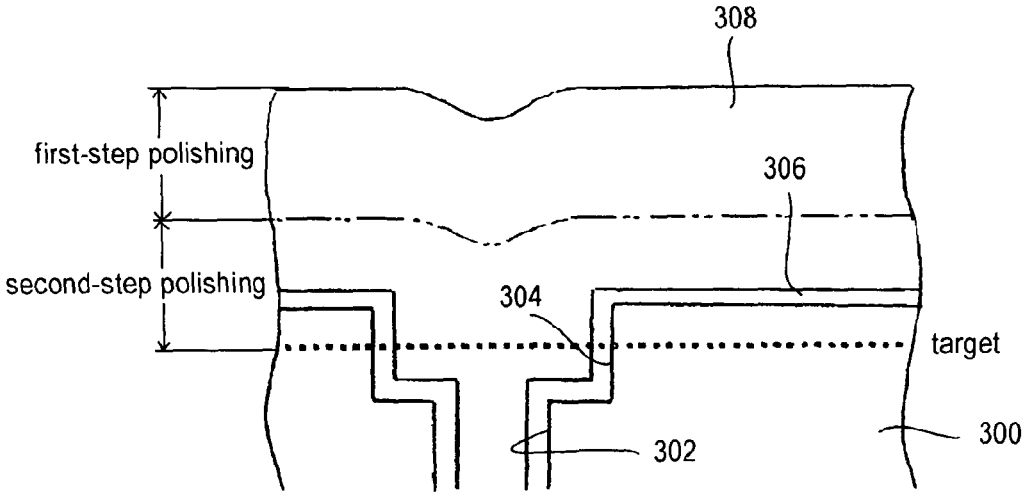
FIG. 12 is a diagram illustrating polishing in the polishing process shown in FIGS. 11A through 11C.

FIGS. 9A through 9C and FIG. 10 show a polishing process according to another embodiment of the present invention, which is applicable to the case where a film to be polished is a metal film. As shown in FIG. 10, the polishing process of this embodiment involves polishing a surface of a substrate, having an insulating film 300 with via holes 302 and trenches 304 formed therein, a barrier layer 306 formed on an entire surface of the insulating film 300, including interior surfaces of the via holes 302 and the trenches 304, and a film of interconnect material 308, such as copper or tungsten, formed on the surface of the barrier layer 306, thereby removing the extra metal film on the insulating film 300, i.e., the barrier layer 306 and the interconnect material 308, and forming interconnects composed of the interconnect material 308 embedded in the via holes 302 and the trenches 304.

First, as shown in FIG. 9A, gating is executed on the first substrate taken out of the cassette 204. In particular, while rotating the top ring 1 holding the first substrate taken out of the cassette 204, the substrate held by the top ring 1 is pressed against the polishing pad 101 of the polishing table 100 and, at the same time, a polishing liquid is supplied from the polishing liquid supply nozzle 102 to the polishing pad 101 to carry out first-step polishing of the surface of the substrate according to a preset polishing recipe (polishing conditions). The first-step polishing mainly effects removal of the extra metal film (barrier layer 306 and interconnect material 308). The end point of the first-step polishing is detected by the torque sensor (measurement section) for measuring the torque of the top ring motor 114. Thus, the first-step polishing is terminated at the point of time when the torque sensor detects exposure of the insulating film 300.

After cleaning and drying the substrate after completion of the first-step polishing, the substrate is transported to the ITM 224, where the surface conditions, such as the thickness of the film, of the substrate after the first-step polishing are measured. Next, second-step polishing is carried out on the substrate. The second-step polishing may be carried either by the polishing table 100 used for the first-step polishing or by the other polishing table 216. The second-step polishing mainly effects polishing of the insulating film 300 underlying the barrier layer 306. The second-step polishing is not intended to completely remove the insulating film 300, but to remove the insulating film 300 only by a predetermined thickness T. Such a polishing step is called "touch-up", and is intended for removal of scratches or the like produced in the surface of the insulating film 300 by the first-step polishing. Such scratches are mainly caused by the polishing liquid (slurry) used in the first-step polishing, and therefore the touch-up polishing is carried out using a different type of polishing liquid.

After cleaning and drying the substrate after completion of the second-step polishing, the substrate is transported to the ITM 224, where the surface conditions, such as the thickness of the film, of the substrate after the second-step polishing are measured. Thereafter, the substrate is returned to the cassette. The polishing process for the first substrate is thus completed, and the gating is terminated.

The polishing liquid, which is supplied to the polishing table 100 during the first-step polishing, preferably has a higher polishing rate for the metal film (interconnect material 308 and barrier layer 306) than that for the insulating film 300, i.e., a higher selectivity. Owing to the selectivity of the polishing liquid, the first-step polishing can be carried out at a considerably lower polishing rate after removal of the metal film and can be completed without excessively removing the insulating film 300 underlying the metal film.

For the second substrate taken out of the cassette, as shown in FIG. 9B, first-step polishing and second-step polishing (touch-up) are carried out successively and, after cleaning and drying the substrate after completion of the second-step polishing, the substrate is transported to the ITM 224, where the surface conditions, such as the thickness of the film, after the second-step polishing are measured. Thereafter, the substrate is returned to the cassette. The polishing process for the second substrate is thus completed.

The polishing recipe for the first-step polishing of the second substrate is the same as the polishing recipe for the first-step polishing of the first substrate, whereas the polishing recipe for the second-polishing of the second substrate is renewed (modified) by feedback of the results of the measurement with the ITM 224 of the surface conditions, such as the thickness of the film, of the first substrate before and after the second-step polishing.

For the third or later substrate (Nth substrate) taken out of the cassette, as shown in FIG. 9C, first-step polishing and second-step polishing (touch-up) are carried out successively and, after cleaning and drying the substrate after completion of the second-step polishing, the substrate is transported to the ITM 224, where the surface conditions, such as the thickness of the film, after the second-step polishing are measured. Thereafter, the substrate is returned to the cassette. The polishing process for the third or later substrate is thus completed.

The polishing recipe for the first-step polishing of the third or later substrate is the same as the polishing recipe for the first-step polishing of the first substrate, whereas the polishing recipe for the second-step polishing of the third or later substrate is renewed (modified) by feedback of the results of the measurement with the ITM 224 of the surface conditions, such as the thickness of the film, of the preceding substrate after the second-step polishing.

Similarly to the embodiment shown in FIG. 7, it is also possible to renew (modify) at least one of the first-step polishing and the second-step polishing.

Figure 13:
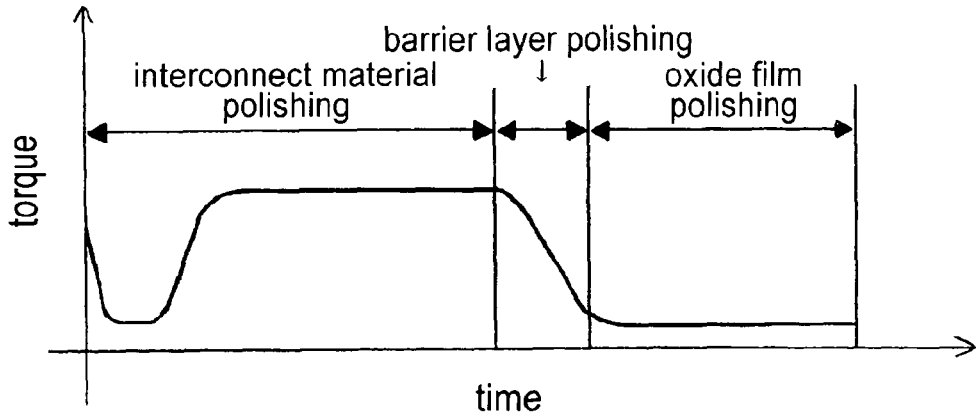
FIG. 13 is a diagram showing the relationship between polishing object and time in the polishing process shown in FIGS. 11A through 11C and FIG. 12.

Though in this embodiment the first-step polishing is terminated when the extra metal film (barrier layer 306 and interconnect material 308) is completely removed, it is also possible to terminate the first-step polishing before the metal film is completely removed and carry out the first-step polishing and the second-step polishing successively, as shown in FIGS. 11A through 11C and FIG. 12. In this case, removal of the metal film is performed also in the second-step polishing and polishing of the insulating film (touch-up) is performed after detection with the torque sensor of the removal of the metal film (barrier layer), i.e. after detection of a rapid decrease in the torque, as shown in FIG. 13. Renewal (modification) of polishing conditions (polishing recipe) is made only to the touch-up polishing after the removal of the metal film. For example, the polishing time solely for polishing the insulating film is renewed by data feedback.

Such a two-step polishing has the advantage that in the case of using the two polishing tables 100, 216 respectively for carrying out the first and second steps, the polishing times of the polishing tables 100, 216 can be made equal. This eliminates the need for waiting for termination of polishing in one polishing table, thus increasing the throughput.

Though in this embodiment the torque sensor and the optical sensor are used for the first-step polishing and the second-step polishing, respectively, it is possible to provide a polishing table with an eddy-current sensor. The three sensors can each be applied to any step of polishing.

Figure 14:
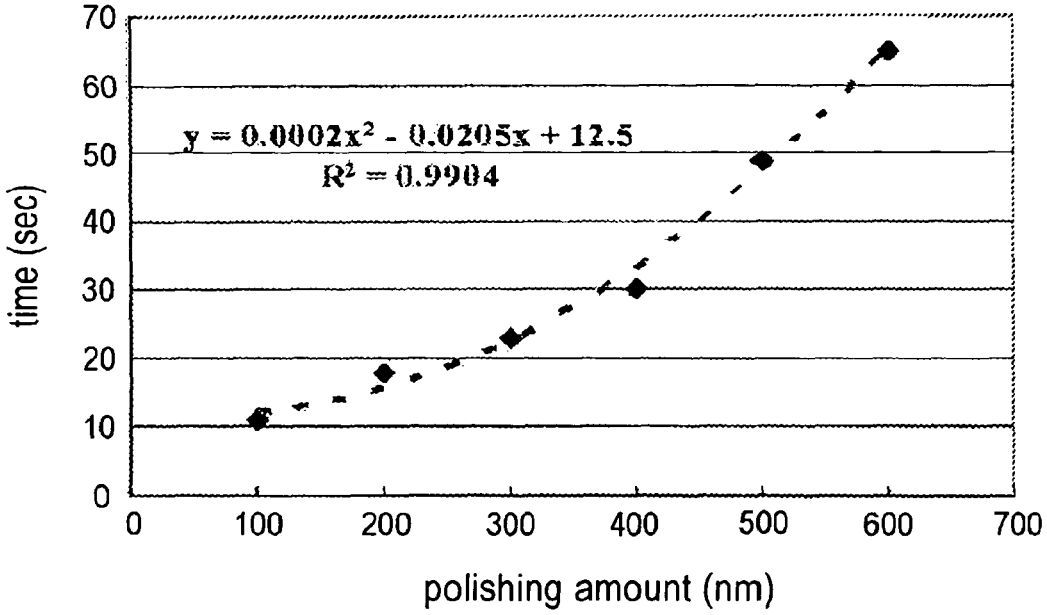
FIG. 14 is a graph showing a relationship between polishing time and polishing amount.

Data on the relationship between polishing time and polishing amount is recorded in the above-described database 404. FIG. 14 is a graph showing a relationship between polishing time and polishing amount. FIG. 15A shows a relationship between polishing time and polishing amount in a time processing mode, and FIG. 15B shows a relationship between polishing time and polishing amount in an approximation mode. An algorithm for determining a polishing rate can be renewed sequentially based on such data. In particular, the amount of data increases with the number of polished substrates, and an approximation formula of polishing rate can be calculated based on data on a relationship between polishing amount and polishing time, stored in the database. As the amount of the data increases, the form of the approximation formula changes to a more precise one.

When carrying out feedback of data in an actual polishing process, an approximation formula of polishing rate will be renewed at specified time intervals to change the polishing rate based on a renewed formula.

Accumulated data on relationship between polishing amount and polishing time is managed in a divisional manner, classified according to the type of a film to be polished, the structure of a pattern, a thickness of a film, etc. In other words, data on substrates, e.g., having the same type of film will be stored as the same data group in the database even when the substrates are stored in different cassettes. Thus, when information, e.g., on the type and a thickness of a film to be polished, obtained, e.g., from a recording medium provided in a cassette, coincides with that stored in the data base, pre-polishing data, or predicted surface conditions of a substrate can be calculated from the database without measurement with an ITM of the initial thickness of the film of the substrate. A polishing recipe also can be obtained simply by calling it up from the database.

As described above, a substrate W after completion of the polishing process is transported to the ITM 224, where the surface conditions, such as a thickness of a film, of the substrate are measured. Polishing conditions (polishing recipe) for each of the areas C1-C4 of the substrate W, shown in FIG. 4, are renewed (modified) based on the data obtained by the measurement, i.e., by feedback of the data. In this embodiment, renewal of a polishing recipe is carried out with regard to polishing rate and profile control. Polishing rate refers to polishing amount per unit time, and profile control refers to setting of a polishing recipe (mainly for pressure) corresponding to each of the areas C1-C4 of the substrate W.

Modification of both of polishing rate and profile control has conventionally been practiced based on data, e.g., on a thickness of a film at any points on a substrate. Modification of a polishing rate is carried out based an average value of a thickness of a film measured at various measurement points on a substrate, and modification of a profile control is carried out based on the thickness of the film in an area (any one of C1-C4) of the substrate. It is thus possible that a measurement point is used for both of modification of polishing rate and modification of profile control. In this case, a polishing recipe will be re-formulated including modification at that point in terms both of polishing rate and profile control. As a result, excessive polishing or, adversely, insufficient polishing can occur at that point.

Figure 16:
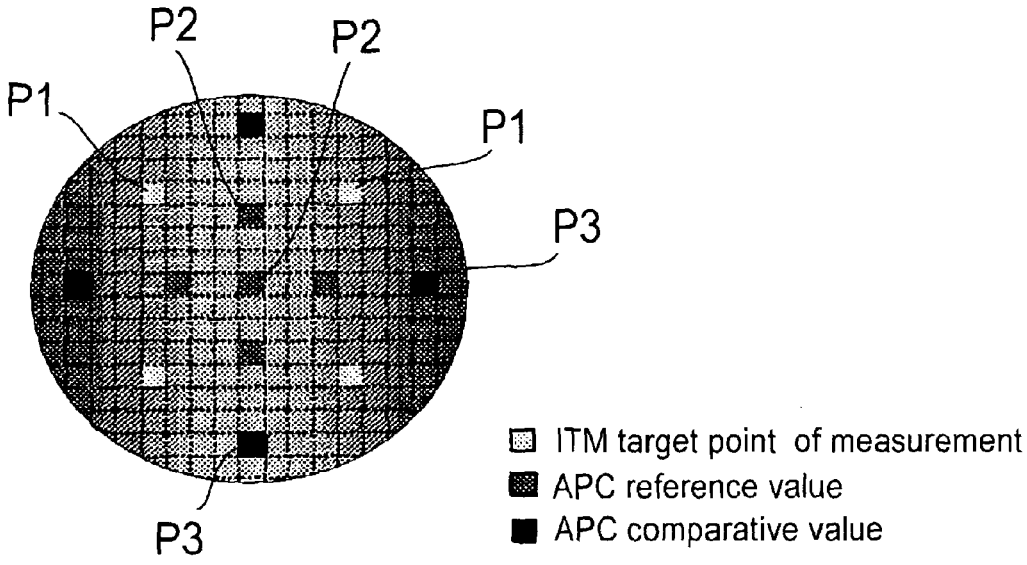
FIG. 16 is a diagram illustrating target points of measurement with an ITM on a substrate (semiconductor wafer), points whose measured values are used as reference values, and points whose measured values are used as comparative values.

In this embodiment, therefore, the controller 400, when obtaining data from the ITM 224, selects measurement points on a substrate in such a manner that points for calculating a polishing rate do not overlap with points for calculating a profile control. For example, when carrying out a profile control only on the area C4 of a substrate, points P1 as target points of measurement with the ITM are first designated on the entire areas C1-C4, and points P2 whose measured values are utilized as reference values are selected from the points P1 in the areas C1-C3 and points P3 whose measured values are utilized as comparative values are selected from the points P1 in the region C4, as shown in FIG. 16. For the calculation of polishing rate, the average of measured values at the points P2 lying in the areas C1-C3, i.e., values utilized as reference values, is used without using measured values at the points P3 lying in the area C4, i.e., values utilized as comparative values. The difference of an average reference value from an average comparative value is phrased as "range", and the profile control becomes possible by preparing a table with the range as an axis. Instead of an average value of measured values, a maximum value, a minimum value, a mode value, etc. may also be employed.

This embodiment completely excludes the case where a measurement point is used both for calculation of a polishing rate and for calculation of a profile control. It is, however, possible to use common measurement points for the both calculations insofar as the number of the common measurement points is so small as not to affect the calculations. This is useful for securing a sufficient amount of date when the number of measurement points is small.

Figure 17:
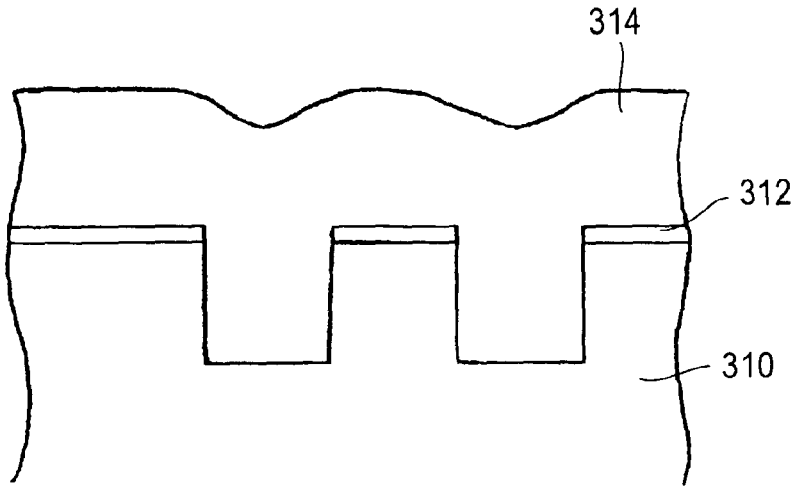
FIG. 17 is a schematic view of a substrate having a laminate of films to be polished.
Figure 18:
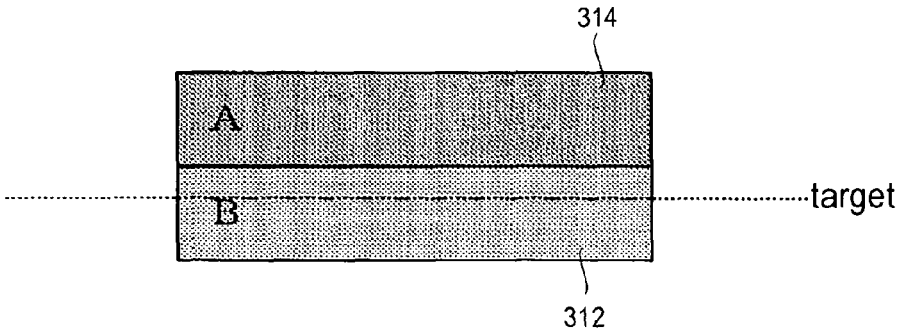
FIG. 18 is an enlarged view of the main portion of the substrate of FIG. 17.

As described above, a polishing liquid having a selectivity is used when polishing a laminate of films formed in a substrate surface. Control of polishing time is generally necessary for a better polishing operation, and the selectivity of a polishing liquid makes the calculation of polishing time difficult. For example, consider now the case of polishing an SiN film 312 and an oxide film 314, superimposed in this order on a silicon substrate 310, as shown in FIG. 17, to a target level lying within the range of the SiN film 312, as shown in FIG. 18. In this case, the manner of modifying polishing conditions (polishing recipe) defers between the case where the oxide film 314 remains unremoved after actual polishing, as shown in FIG. 19, and the case where the oxide film 314 is completely removed by actual polishing, as shown in FIG. 20.

Figure 19:
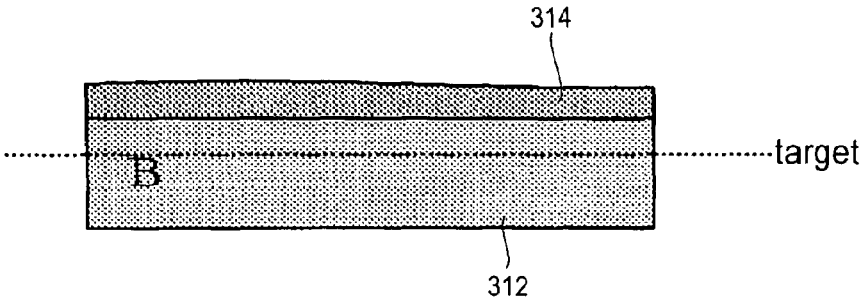
FIG. 19 is a diagram illustrating the surface state of the substrate shown in FIG. 18 after polishing in the case where the upper film remains unremoved.
Figure 20:
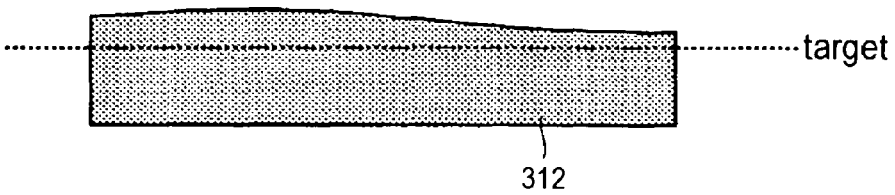
FIG. 20 is a diagram illustrating the surface state of the substrate shown in FIG. 18 after polishing in the case where the upper film has been completely removed.

In particular, in the case where the oxide film 314 remains unremoved as shown in FIG. 19, the selectivity of the polishing liquid used, i.e., the polishing rate ratio between the oxide film and the SiN film, must be taken into account in modifying a polishing recipe. On the other hand, in the case where the oxide film 314 is completely removed as shown in FIG. 20, modification of a polishing recipe can be made taking account only of the polishing rate of the SiN film 312. Therefore, when modifying a polishing recipe, it is necessary for the worker to determine whether the oxide film 314 is completely removed or not based on the results of measurement of the thickness of the remaining film. The determination work is generally difficult and requires a lot of time.

In this embodiment, therefore, a synthetic film thickness value reflecting the selectivity of a polishing liquid is calculated in advance. For example, when carrying polishing of an oxide film and an SiN film using a polishing liquid having the following selectivity: the polishing rate ratio of the oxide film:the SiN film=5:1, the thickness of the SiN film is set five times the actual thickness of the SiN film, and the thus-set thickness is added to the thickness of the oxide film to give a synthetic film thickness value, as shown in FIG. 21.

The use of such a synthetic film thickness value makes it possible to carry out polishing of a laminate of various types of films under the same conditions as when polishing a single type of film. This eliminates the need for the above-described troublesome determination work, and enables autonomous modification of a polishing recipe by loading a program for executing the above calculation into the host computer.

More specifically, the calculation of a synthetic film thickness value is possible provided the types of films to be polished, laminated on a substrate, the structure of the laminate, the thickness of each film and the selectivity of the polishing liquid used are known. By recording and accumulating such data in the database, the number of the types of films, for which autonomous calculation of synthetic film thickness values is possible, will increase. Further, the accuracy of synthesis will increase by accumulating data on the results of polishing carried out with the use of a calculated synthetic film thickness value. In the case of using a polishing liquid having no selectivity, a synthetic film thickness value can be calculated by taking the selectivity for target films, i.e., the polishing rate ratio between the films, as one (1). This can avoid a troublesome procedure of switching the operating conditions of a program depending on whether the polishing liquid used has a selectivity or not, when carrying out polishing.

As with APC of polishing (CMP) which carries out measurement of a thickness of a film after completion of the process to make judgment of acceptance, it is a widespread practice in a highly-automated factory to carry out similar measurement and judgment of acceptance also in a pre-polishing process and in a post-polishing process. If data on the results of the measurement in the pre-polishing process, i.e., data on the final film thickness value (remain) upon completion of the pre-polishing process, is incorporated into a polishing apparatus, and the data is read out from a host computer to utilize it as an initial film thickness in polishing, the time for measurement of initial film thickness can be omitted, leading to an increased throughput. Furthermore, the data on the initial film thickness can be obtained for all of the substrates to be polished. This will enhance the accuracy of CLC (closed-loop control), or increase the possibility of employing CLC even in a process for which an ITM cannot be used.

For example, data on a thickness of a film of a substrate, measured with a film thickness measuring device of a pre-polishing plating apparatus, may be used as a pre-polishing film thickness data of the substrate to be polished in a polishing apparatus, or data on a thickness of a film of a substrate after polishing, measured with a film thickness measuring device of a polishing apparatus, may be used as a pre-processing data for a post-polishing processing apparatus.

The polishing method and the polishing apparatus of the present invention make it possible to carry out a multi-step polishing process with improved polishing conditions (polishing recipe) while omitting as much as possible measurement of the surface conditions of a workpiece, such as a substrate, with a measurement section such as an ITM, as carried out between polishing steps, thereby increasing the throughput.

What is claimed is:

1. A polishing method for polishing workpieces, the polishing method comprising:

performing a first polishing process on a first workpiece first taken out of a cassette in which a plurality of workpieces are stored, the first polishing process comprising (i) measuring a surface of the first workpiece before polishing, (ii) polishing the surface of the first workpiece multiple times under preset conditions, and measuring the surface of the first workpiece between each polishing, and (iii) measuring the surface of the first workpiece after polishing the surface of the first workpiece multiple times; and performing a second polishing process on a second or later workpiece later taken out of a cassette, the second polishing process comprising (iv) measuring a surface of the second or later workpiece before polishing, (v) polishing the surface of the second or later workpiece multiple times successively under polishing conditions without measuring the surface of the second or later workpiece between each polishing, and (vi) measuring the surface of the second or later workpiece after polishing, wherein the polishing conditions for at least one polishing of the multiple polishings of the surface of the second workpiece are modified based on the results of the measuring in (i), (ii) and (iii) of the performing a first polishing process on the first workpiece, and the polishing conditions for at least one polishing of multiple polishings of a surface of a third workpiece are modified based on the results of the measuring in (iv) and (vi) of the performing a second polishing process on the second workpiece.

2. The polishing method according to claim 1, wherein the polishing in the first polishing process and the polishing in the second polishing process are performed by pressing the surface of a respective workpiece against a polishing pad having a polishing surface while moving the respective workpiece and the polishing pad relative to each other.

3. The polishing method according to claim 2, wherein the polishing conditions for the first polishing process and the second polishing process are set based on a degree of wear of the polishing pad determined by counting a number of workpieces polished with the polishing pad.

4. The polishing method according to claim 3, wherein an approximation formula of a polishing rate is calculated based on data on a relationship between polishing time and polishing amount recorded after each polishing, and the polishing conditions are set based on calculated approximation formula.

5. The polishing method according to claim 4, wherein an algorithm for determining the polishing rate is renewed sequentially as the amount of the data increases.

* * * * *